US009212572B2

(12) United States Patent
Fujitsuka et al.

(10) Patent No.: US 9,212,572 B2
(45) Date of Patent: Dec. 15, 2015

(54) SINTERED VALVE GUIDE AND PRODUCTION METHOD THEREFOR

(75) Inventors: Hiroki Fujitsuka, Matsudo (JP); Hideaki Kawata, Matsudo (JP)

(73) Assignee: HITACHI POWDERED METALS CO., LTD., Chiba (JP)

( * ) Notice: Subject to any disclaimer, the term of this patent is extended or adjusted under 35 U.S.C. 154(b) by 817 days.

(21) Appl. No.: 12/967,570

(22) Filed: Dec. 14, 2010

(65) Prior Publication Data

US 2011/0146448 A1 Jun. 23, 2011

(30) Foreign Application Priority Data

Dec. 21, 2009 (JP) ..... 2009-289753
Sep. 30, 2010 (JP) ..... 2010-221578

(51) Int. Cl.

| | |
|---|---|
| ***C22C 33/02*** | (2006.01) |
| ***F01L 3/08*** | (2006.01) |
| ***C22C 1/10*** | (2006.01) |
| ***C22C 32/00*** | (2006.01) |
| *F01L 1/16* | (2006.01) |

(52) U.S. Cl.

CPC ..... *F01L 3/08* (2013.01); *C22C 1/1084* (2013.01); *C22C 32/0047* (2013.01); *C22C 33/0228* (2013.01); *C22C 33/0242* (2013.01); *C22C 33/0257* (2013.01); *F01L 1/16* (2013.01); *F01L 2101/00* (2013.01)

(58) Field of Classification Search

USPC ..... 75/236, 240
See application file for complete search history.

(56) References Cited

U.S. PATENT DOCUMENTS

| | | | | |
|---|---|---|---|---|
| 4,702,771 | A | 10/1987 | Takagi et al. | |
| 5,259,860 | A | 11/1993 | Ikenoue et al. | |
| 5,507,257 | A | 4/1996 | Sakai et al. | |
| 5,870,989 | A | 2/1999 | Takahashi et al. | |
| 6,012,703 | A | 1/2000 | Hayashi et al. | |
| 2006/0032328 | A1 | 2/2006 | Chikahata et al. | |
| 2006/0219054 | A1 * | 10/2006 | Kawata et al. | 75/230 |
| 2009/0165595 | A1 * | 7/2009 | Yamamoto et al. | 75/243 |

FOREIGN PATENT DOCUMENTS

| | | | |
|---|---|---|---|
| DE | 691 16 638 | T2 | 9/1996 |
| DE | 697 05 289 | T2 | 11/2001 |
| EP | 0 621 347 | A1 | 10/1994 |
| EP | 1 619 263 | A1 | 1/2006 |

(Continued)

OTHER PUBLICATIONS

Kawata et al., "Recent Trends in Heat Resistant/Wear Resistant Sintered Alloys," *Hitachi Powdered Metals Technical Report*, No. 6, 2007, pp. 3-11.

(Continued)

*Primary Examiner* — George Wyszomierski
*Assistant Examiner* — Ngoclan T Mai
(74) *Attorney, Agent, or Firm* — Oliff PLC

(57) ABSTRACT

A sintered valve guide exhibits a metallic structure having a mixed structure and a hard phase in which hard particles are dispersed in an alloy matrix. The mixed structure consists of pearlite, an Fe—P—C ternary eutectic phase, a ferrite phase, a copper phase, and pores, and the mixed structure consists of, by mass %, 0.075 to 0.525% of P, 3.0 to 10.0% of Cu, 1.0 to 3.0% of C, and the balance of Fe and inevitable impurities. The hard phase is dispersed at 2 to 15 mass % in the mixed structure.

13 Claims, 1 Drawing Sheet

(56) References Cited

FOREIGN PATENT DOCUMENTS

| | | |
|---|---|---|
| GB | 1 500 736 | 2/1978 |
| JP | B2-55-34858 | 9/1980 |
| JP | A-56-020144 | 2/1981 |
| JP | A-60-159154 | 8/1985 |
| JP | A-63-290245 | 11/1988 |
| JP | A-4-157140 | 5/1992 |
| JP | A-09-235659 | 9/1997 |

OTHER PUBLICATIONS

British Search Report dated Apr. 8, 2011 issued in British Patent Application No. 1021678.6.

Office Action issued in German Patent Application No. 10 2010 055 463.4 dated Aug. 14, 2012 (with translation).

* cited by examiner

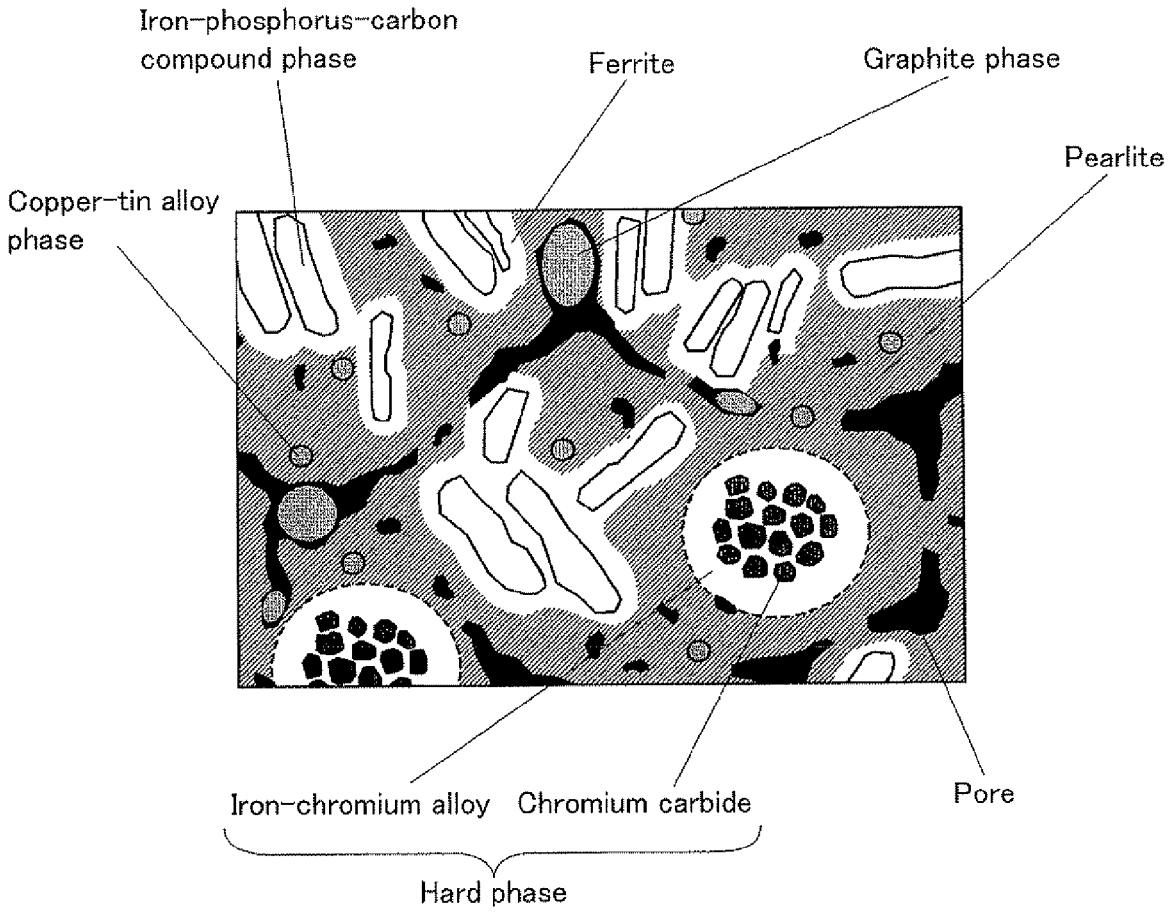
Iron-phosphorus-carbon compound phase
Ferrite
Graphite phase
Pearlite
Copper-tin alloy phase
Iron-chromium alloy
Chromium carbide
Pore
Hard phase

SINTERED VALVE GUIDE AND PRODUCTION METHOD THEREFOR

BACKGROUND OF THE INVENTION

1. Technical Field

The present invention relates to a sintered valve guide that may be used in an internal combustion engine, and also relates to a production method for the sintered valve guide. Specifically, the present invention relates to a technique for further improving wear resistance of the sintered valve guide.

2. Background Art

A valve guide used in an internal combustion engine is a tubular component having an inner circumferential surface for guiding valve stems of an intake valve and an exhaust valve. The intake valve may be driven so as to take fuel gas into a combustion chamber of the internal combustion engine, and the exhaust valve may be driven so as to exhaust combustion gas from the combustion chamber. Therefore, the valve guide is required to have wear resistance and is also required to maintain smooth sliding conditions so as not to cause to wear the valve stems for long periods. Valve guides made of a cast iron are generally used, but valve guides made of a sintered alloy have recently come into wide use. This is because sintered alloys can have a specific metallic structure, which cannot be obtained from ingot materials, and therefore the sintered alloys can have wear resistance. Moreover, once a die assembly has been made, products having the same shape can be mass-produced, and therefore the sintered alloys are suitable for commercial production. Furthermore, a sintered alloy can be formed into a shape similar to that of a product, and thereby material yield can be high in machining. For example, a sintered alloy has a metallic structure in which an iron-phosphorus-carbon compound phase is precipitated and free graphite particles are dispersed in a pearlitic matrix. In this case, the pearlitic matrix is strengthened by adding copper and tin. Sintered valve guides made of this sintered alloy are disclosed in Japanese Examined Patent Publication No. 55-034858 and Japanese Patent Application of Laid-Open No. 4-157140. These sintered valve guides have been mounted in automobiles and have been commercially used as automobile valve guides by domestic and international automobile manufacturers.

SUMMARY OF THE INVENTION

In accordance with trends toward improving the performance and the fuel efficiency of automobile internal combustion engines in recent years, valve guides have been subjected to higher temperatures and higher pressures while internal combustion engines are running. Moreover, in view of recent environmental issues, amounts of lubricant supplied to an interface between a valve guide and a valve stem have decreased. Therefore, valve guides must withstand under more severe sliding conditions. In view of these circumstances, valve guides are required to have higher wear resistance, and thus wear resistance of sintered valve guides need to be further improved. Accordingly, an object of the present invention is to provide a sintered valve guide and a production method therefor, and the sintered valve guide has improved wear resistance compared with those of sintered valve guides disclosed in Japanese Examined Patent Publication No. 55-034858 and Japanese Patent Application of Laid-Open No. 4-157140.

The present invention provides a sintered valve guide exhibiting a metallic structure having a mixed structure and a hard phase in which hard particles are dispersed in an alloy matrix. The mixed structure consists of pearlite, an Fe—P—C ternary eutectic phase, a ferrite phase, a copper phase, and pores, and the mixed structure consists of, by mass %, 0.075 to 0.525% of P, 3.0 to 10.0% of Cu, 1.0 to 3.0% of C, and the balance of Fe and inevitable impurities. The hard phase is dispersed at 2 to 15 mass % in the mixed structure.

The mixed structure preferably further includes not greater than 1.1 mass % of Sn, and the copper phase is preferably partially or wholly made of a copper-tin alloy phase.

In the hard phase, the hard particles are preferably concentrated in the alloy matrix of the hard phase. The hard particles are preferably at least one kind selected from the group consisting of molybdenum silicides, chromium carbides, molybdenum carbides, vanadium carbides, and tungsten carbides. The alloy matrix of the hard phase is preferably one kind of an iron-based alloy and a cobalt-based alloy.

Furthermore, the hard phase is more preferably made of at least one selected from the group consisting of (A) a hard phase consisting of, by mass %, 4 to 25% of Cr, 0.25 to 2.4% of C, and the balance of Fe and inevitable impurities, (B) a hard phase consisting of, by mass %, 4 to 25% of Cr, 0.25 to 2.4% of C, at least one of 0.3 to 3.0% of Mo and 0.2 to 2.2% of V, and the balance of Fe and inevitable impurities, (C) a hard phase consisting of, by mass %, 4 to 8% of Mo, 0.5 to 3% of V, 4 to 8% of W, 2 to 6% of Cr, 0.6 to 1.2% of C, and the balance of Fe and inevitable impurities, (D) a hard phase consisting of, by mass %, 0.5 to 10% of Si, 10 to 50% of Mo, and the balance of Fe and inevitable impurities, (E) a hard phase consisting of, by mass %, 0.5 to 10% of Si, 10 to 50% of Mo, at least one selected from the group consisting of 0.5 to 10% of Cr, 0.5 to 10% of Ni, and 0.5 to 5% of Mn, and the balance of Fe and inevitable impurities, and (F) a hard phase consisting of, by mass %, 1.5 to 3.5% of Si, 7 to 11% of Cr, 26 to 30% of Mo, and the balance of Co and inevitable impurities.

The present invention provides a production method for a sintered valve guide, and the production method includes preparing an iron powder, an iron-phosphorus alloy powder consisting of 15 to 21 mass % of P and the balance of Fe and inevitable impurities, a copper powder, a graphite powder, and a hard phase forming powder. The production method also includes mixing 0.5 to 2.5 mass % of the iron-phosphorus alloy powder, 3 to 10 mass % of the copper powder, 1 to 3 mass % of the graphite powder, and 2 to 15 mass % of the hard phase forming powder with the iron powder into a raw powder. The production method further includes filling a tube-shaped cavity of a die assembly with the raw powder, compacting the raw powder into a green compact having a tube shape, and sintering the green compact at a heating temperature of 950 to 1050° C. in a nonoxidizing atmosphere.

Moreover, the overall composition of the raw powder preferably includes 3 to 10 mass % of Cu and not greater than 1.1 mass % of Sn. Therefore, the production method preferably further includes adding at least one kind of a tin powder and a copper-tin alloy powder, which consists of not less than 8 mass % of Sn and the balance of Cu and inevitable impurities, to the raw powder while adjusting the amount of the copper powder. Alternatively, the production method preferably further includes adding the copper-tin alloy powder, or both the tin powder and the copper-tin alloy powder, to the raw powder, instead of adding the copper powder.

Furthermore, the hard phase forming powder is more preferably made of at least one selected from the group consisting of (A) a hard phase forming powder consisting of, by mass %, 4 to 25% of Cr, 0.25 to 2.4% of C, and the balance of Fe and inevitable impurities, (B) a hard phase forming powder consisting of, by mass %, 4 to 25% of Cr, 0.25 to 2.4% of C, at least one of 0.3 to 3.0% of Mo and 0.2 to 2.2% of V, and the balance of Fe and inevitable impurities, (C) a hard phase forming powder consisting of, by mass %, 4 to 8% of Mo, 0.5 to 3% of V, 4 to 8% of W, 2 to 6% of Cr, 0.6 to 1.2% of C, and the balance of Fe and inevitable impurities, (D) a hard phase forming powder consisting of, by mass %, 0.5 to 10% of Si, 10 to 50% of Mo, and the balance of Fe and inevitable impurities, (E) a hard phase forming powder consisting of, by mass %, 0.5 to 10% of Si, 10 to 50% of Mo, at least one selected from the group consisting of 0.5 to 10% of Cr, 0.5 to 10% of Ni, and 0.5 to 5% of Mn, and the balance of Fe and inevitable impurities, and (F) a hard phase forming powder consisting of, by mass %, 1.5 to 3.5% of Si, 7 to 11% of Cr, 26 to 30% of Mo, and the balance of Co and inevitable impurities.

In the sintered valve guide of the present invention, the Fe—P—C ternary eutectic phase (hereinafter called "iron-phosphorus-carbon compound phase") and also the hard phase are dispersed in the iron-based matrix, whereby the wear resistance is improved. Therefore, the sintered valve guide of the present invention is preferably used for valve guides used in sliding conditions that have recently become severe. Moreover, according to the production method for the sintered valve guide of the present invention, the sintered valve guide can be produced as easily as in a conventional manner.

BRIEF DESCRIPTION OF THE DRAWING

FIG. 1 is a schematic view showing a metallic structure of a sintered valve guide of the present invention.

PREFERRED EMBODIMENT OF THE INVENTION

The inventors of the present invention have endeavored to improve a sintered valve guide based on the sintered valve guide disclosed in Japanese Examined Patent Publication No. 55-034858, and they found the following. That is, by dispersing an iron-phosphorus-carbon compound phase and also a hard phase in a matrix, wear resistance is greatly improved. In addition, they found a hard phase in which hard particles are concentrated and are dispersed in an alloy matrix made of one of an iron-based alloy and a cobalt alloy. The hard particles are at least one kind selected from the group consisting of molybdenum silicides, chromium carbides, molybdenum carbides, vanadium carbides, and tungsten carbides. This hard phase does not greatly decrease strength and is preferably used for greatly improving wear resistance. The present invention has been achieved based on these findings, and a metallic structure and grounds for limiting amounts of compositions of the present invention will be described with functions of the present invention hereinafter.

The sintered valve guide of the present invention has a metallic structure in which pores are dispersed. By impregnating the pores with lubricant, the sintered valve guide retains the lubricant and can smoothly slide along a valve stem. Moreover, when some of the lubricant is consumed, supplemental lubricant will be provided from a valve system and reaches an inner circumferential surface, at which the sintered valve guide slides on a valve, through the pores. The amount of the pores having such functions is suitably 10 to 20 volume %. If the amount of the pores is less than 10 volume %, the sintered valve guide may not sufficiently retain the lubricant, and the supplemental lubricant may not be sufficiently provided when the lubricant is consumed. On the other hand, if the amount of pores is greater than 20 volume %, the amount of the matrix is relatively decreased, whereby strength of the sintered alloy is greatly decreased. Moreover, there may be cases in which the lubricant leaks to an exhaust side of the sintered valve guide and generates white smoke.

The sintered valve guide of the present invention has a matrix made of a mixed structure of a pearlite phase, an iron-phosphorus-carbon compound phase, a ferrite phase, and a copper phase, and the sintered valve guide exhibits a metallic structure in which a hard phase is dispersed in the matrix.

In the matrix of the sintered valve guide, the amount of the pearlite structure is not less than 50% of the matrix by cross-sectional area so as to increase strength of the matrix. By sintering a raw powder which is a mixture of an iron powder and a graphite powder, the carbon is dispersed into the iron powder, whereby the matrix of the sintered valve guide is formed. The iron powder and the graphite powder are used as the raw powder because a metallic powder, in which carbon is solid-solved in metal, is hard and has low compressibility. If the amount of the graphite powder is insufficient, the amount of the carbon combining with the matrix comes to be insufficient, and a large amount of ferrite phase (α-iron) is formed, whereby the strength of the matrix is decreased.

The iron-phosphorus-carbon compound phase is dispersed in the pearlitic matrix. By mixing the graphite powder and an iron-phosphorus alloy powder with the iron powder and by sintering them, an iron-phosphorus-carbon compound is precipitated in the form of plates at a crystal grain boundary of the pearlite phase and forms a hard iron-phosphorus-carbon compound phase. Consequently, the wear resistance of the sintered alloy is improved. In forming of the iron-phosphorus-carbon compound phase, a ferrite phase is formed around the iron-phosphorus-carbon compound phase. In this case, as long as not less than 50% of the matrix is made of pearlite by area ratio as described above, even when the ferrite is formed as a residue, the strength of the matrix is not greatly decreased, and the amount of the ferrite is acceptable. The amount of the graphite powder will be described hereinafter.

In order to form the iron-phosphorus-carbon compound phase, the sintered alloy requires P. If the amount of P in the sintered alloy in the overall composition is less than 0.075 mass %, the iron-phosphorus-carbon compound phase is not sufficiently formed, whereby the effect for improving the wear resistance is not sufficiently obtained. On the other hand, if the amount of P is greater than 0.525 mass %, too much of the iron-phosphorus-carbon compound phase is formed, whereby the matrix of the sintered alloy is embrittled. Therefore, the strength of the sintered alloy is decreased, and the degree of wear characteristics with respect to a mating material is remarkably increased. Accordingly, the amount of P in the overall composition is set to be 0.075 to 0.525 mass %.

P is added to the raw powder in the form of an iron-phosphorus alloy powder, which is easy to handle. An iron-phosphorus alloy including approximately 10 to 13 mass % of P forms a liquid phase thereof at temperatures between 950 and 1050° C. Although a large amount of the liquid phase decreases dimensional stability of the sintered alloy and is not preferable, an appropriate amount of the liquid phase accelerates neck growth and thereby improves the strength of the sintered alloy. Accordingly, in order to appropriately control the formation of the liquid phase, an iron-phosphorus alloy powder including not less than 15 mass % of P is used.

P in the iron-phosphorus alloy powder including not less than 15 mass % of P is dispersed into the iron powder in sintering. Therefore, the amount of P in the iron-phosphorus alloy powder is partially in the above range, whereby a liquid phase is formed. The liquid phase wets and covers the surface of the iron powder particles, and then P is rapidly dispersed from this liquid phase into the iron powder. As a result, the amount of P included in the liquid phase comes to be below the above range, and the liquid phase transforms into a solid phase. Therefore, the neck growth between the iron powder particles is accelerated, whereby the strength is improved. In addition, the liquid phase is formed at a part of the iron powder and transforms into the solid phase for a short time, whereby large decreases in dimensional stability are prevented.

If the amount of P in the iron-phosphorus alloy powder is less than 15 mass %, the composition of the iron-phosphorus alloy comes to be in the above range of formation of the liquid phase because of the dispersion of P in sintering. As a result, a large amount of the liquid phase is formed, whereby the dimensional stability is decreased. On the other hand, if the amount of P in the iron-phosphorus alloy powder is greater than 21 mass %, the iron-phosphorus alloy powder is hardened, whereby a compressibility of the raw powder is decreased. Therefore, densities of the green compact and the sintered alloy are decreased, and the strength of the sintered valve guide comes to be insufficient. Accordingly, an iron-phosphorus alloy powder including 15 to 21 mass % of P is used, and the amount of the iron-phosphorus alloy powder in the total amount of the raw powder is set to be approximately 0.5 to 2.5 mass %.

In the matrix of the sintered alloy having a mixed structure, in which the iron-phosphorus-carbon compound phase is dispersed in the pearlitic matrix, a copper phase is also dispersed. The copper phase is formed by copper remaining in the metallic structure in sintering of the raw powder, in which a copper powder is mixed. The copper phase is soft and improves adaptability to a valve, which is a sliding mating material, and also thermal conductivity. Therefore, the wear resistance and machinability of the sintered alloy are improved. These effects of the copper phase are efficiently obtained in a condition in which the copper phase is dispersed in the matrix at not less than 0.5% of an observation area of a sectional structure. Accordingly, the amount of the copper phase is preferably set to be not less than 0.5% of an observation area of a sectional structure.

The copper powder not only forms the copper phase but also accelerates sintering. Moreover, some of the copper powder is dispersed and is solid-solved in the matrix, thereby improving the strength of the matrix. If the amount of Cu in the overall composition is less than 3 mass %, the above effects are not sufficiently obtained. On the other hand, if the amount of Cu is greater than 10 mass %, the above effects are not greatly improved for the amount. Therefore, the amount of Cu in the overall composition is set to be 3 to 10 mass %. Cu is added to the raw powder in the form of a copper powder. Accordingly, the amount of the copper powder in the raw powder is set to be 3 to 10 mass %.

In the sintered valve guide, the strength of the sintered alloy is further improved by adding not greater than 1.1 mass % of Sn in the overall composition. Since the melting point of Sn is 232° C. and is low, Sn melts and forms a liquid phase while temperature rises to the above sintering temperature. Therefore, Sn facilitates the sintering and thereby improves the strength of the sintered alloy. In addition, some of Sn is alloyed with Cu and strengthens the copper phase, whereby Sn improves the strength of the sintered alloy. In this case, a part or the entire amount of the copper phase dispersed in the sintered alloy is transformed into a copper-tin alloy phase. If the amount of Sn is greater than 1.1 mass %, Sn causes embrittlement of the sintered alloy. Therefore, the amount of Sn is required to be not greater than 1.1 mass %.

Sn having the above effects may be added to the raw powder in the form of a tin powder, but if Sn is added in the form of a copper-tin alloy powder, a uniform structure is easily obtained. In a case of using the copper-tin alloy powder, the temperature of formation of the liquid phase increases with the decreasing of the amount of Sn. Therefore, in order to obtain the above effects, the copper-tin alloy powder is required to have a composition so that the temperature of formation of the liquid phase will not be above 900° C. Accordingly, the amount of Sn in the copper-tin alloy powder is set to be not less than 8 mass %.

If the amount of Sn in the copper-tin alloy powder is large, the temperature of formation of the liquid phase is decreased, and the amount of Sn dispersed in the matrix of the sintered alloy is increased. Therefore, in order to strengthen the copper phase by Sn, the amount of Sn in the copper-tin alloy powder is set to be not greater than 11 mass %. As a result, the temperature of formation of the liquid phase comes to be not less than 800° C., whereby the formation of the liquid phase will be delayed while the temperature rises to the sintering temperature. Accordingly, the amount of Sn dispersed in the matrix of the sintered alloy is decreased, while the amount of Sn solid-solved in the copper-tin alloy phase is increased. The tin powder and the copper-tin alloy powder may be added to the raw powder either alone or in combination. When the copper-tin alloy powder is used, it is necessary to adjust the amount of the copper powder added to the raw powder so that the amount of Cu in the raw powder is 3 to 10 mass %. Alternatively, the entire amount of the copper powder may be replaced with the copper-tin alloy powder.

In the matrix of the sintered alloy having a mixed structure, in which the iron-phosphorus-carbon compound phase, and at least one of the copper phase and the copper-tin alloy phase, are dispersed in the pearlitic matrix, a hard phase is also dispersed. The hard phase exhibits a complex structure in which hard particles of at least one of a metallic carbide and an intermetallic compound are concentrated and are precipitated in a soft alloy matrix. The hard particles of the metallic carbide and the intermetallic compound improve the wear resistance of the hard phase. Moreover, since the hard phase is formed by surrounding the hard particles of at least one of the metallic carbide and the intermetallic compound with the soft alloy matrix, the hard phase reduces the degree of the wear characteristics with respect to a mating material. By dispersing the hard phase having such complex structure into the matrix of the sintered alloy, the wear resistance of the sintered alloy is improved without increasing the degree of the wear characteristics with respect to a mating material. The metallic carbide and the intermetallic compound are precipitated from the alloy matrix of the hard phase and are dispersed therein. Therefore, the metallic carbide and the intermetallic compound are firmly fixed to the alloy matrix of the hard phase and do not easily exfoliate. This characteristic also improves the wear resistance.

In order to obtain the above effects, the alloy matrix of the hard phase is required to be relatively soft and to firmly fix the hard phase to the matrix of the sintered alloy after being dispersed. That is, an iron-based alloy or a cobalt-based alloy is suitable for the alloy matrix of the hard phase. On the other hand, the hard particles are required to have high hardness and to be firmly fixed to the alloy matrix of the hard phase. Therefore, molybdenum silicides, chromium carbides, molybdenum carbides, vanadium carbides, and tungsten carbides are suitable for the hard particles, and at least one kind of these hard particles is preferably concentrated and precipitated in the alloy matrix of the hard phase.

By mixing a hard phase forming powder with the raw powder, which is a mixture of the graphite powder and the iron-phosphorus-carbon alloy powder, and by sintering them, the hard phase exhibiting the complex structure is dispersed in the matrix. Therefore, the amount of the hard phase dispersed in the matrix of the sintered alloy depends on the amount of the hard phase forming powder added to the raw powder. If the amount of the hard phase dispersed in the matrix of the sintered alloy is less than 2 mass %, the amount of the hard phase is insufficient, and the effect for improving the wear resistance is not sufficiently obtained. On the other hand, if the amount of the hard phase dispersed in the matrix is greater than 15 mass %, the amount of the hard phase forming powder in the raw powder is large, whereby the compressibility of the raw powder is decreased. Moreover, the amount of the hard phase dispersed in the matrix of the sintered alloy becomes too high, whereby the degree of the wear characteristics with respect to a valve stem is increased, and the sintered alloy may cause wear of the valve stem. Accordingly, the upper limit of the amount of the hard phase forming powder is set to be 15 mass %.

Specifically, the hard phase preferably made of at least one kind selected from the group consisting of (A) a hard phase consisting of, by mass %, 4 to 25% of Cr, 0.25 to 2.4% of C, and the balance of Fe and inevitable impurities, (B) a hard phase consisting of, by mass %, 4 to 25% of Cr, 0.25 to 2.4% of C, at least one of 0.3 to 3.0% of Mo and 0.2 to 2.2% of V, and the balance of Fe and inevitable impurities, (C) a hard phase consisting of, by mass %, 4 to 8% of Mo, 0.5 to 3% of V, 4 to 8% of W, 2 to 6% of Cr, 0.6 to 1.2% of C, and the balance of Fe and inevitable impurities, (D) a hard phase consisting of, by mass %, 0.5 to 10% of Si, 10 to 50% of Mo, and the balance of Fe and inevitable impurities, (E) a hard phase consisting of, by mass %, 0.5 to 10% of Si, 10 to 50% of Mo, at least one selected from the group consisting of 0.5 to 10% of Cr, 0.5 to 10% of Ni, and 0.5 to 5% of Mn, and the balance of Fe and inevitable impurities, and (F) a hard phase consisting of, by mass %, 1.5 to 3.5% of Si, 7 to 11% of Cr, 26 to 30% of Mo, and the balance of Co and inevitable impurities.

Hard Phase (A)

The hard phase (A) includes hard particles made of chromium carbides and has an alloy matrix made of an iron-chromium alloy. As the hard phase forming powder, a hard phase forming powder consisting of, by mass %, 4 to 25% of Cr, 0.25 to 2.4% of C, and the balance of Fe and inevitable impurities is used. Therefore, a hard phase, in which chromium carbides are dispersed in an iron-chromium alloy matrix, is formed.

Cr included in the hard phase forming powder forms chromium carbides, thereby improving the wear resistance of the sintered alloy. Moreover, Cr is solid-solved in the alloy matrix of the hard phase and strengthens the alloy matrix, thereby improving the wear resistance and the strength of the hard phase. In addition, some of the Cr is dispersed from the hard phase forming powder into the matrix, thereby increasing fixability of the hard phase with respect to the matrix of the sintered alloy. Moreover, some of the Cr is solid-solved in the matrix of the sintered alloy and strengthens the matrix, thereby improving the wear resistance and the strength of the sintered alloy.

If the amount of Cr included in the hard phase forming powder is less than 4 mass %, the above effects are not sufficiently obtained. On the other hand, if the amount of Cr is greater than 25 mass %, too much of the chromium carbides are precipitated, whereby wear of a mating material such as a valve stem is accelerated. In addition, the amount of Cr solid-solved in the hard phase forming powder is too large, whereby the hard phase forming powder is hardened, and the compressibility of the raw powder is decreased. Accordingly, the amount of Cr included in the hard phase forming powder is set to be 4 to 25 mass %.

Instead of adding the entire amount of Cr to the hard phase forming powder by solid solving, chromium carbides may be preliminarily precipitated in the hard phase forming powder by adding C to the hard phase forming powder. In this case, the amount of Cr solid-solved in the matrix of the hard phase forming powder is decreased, and thereby the hardness of the matrix is decreased. As a result, even when hard chromium carbides are precipitated in a part of the hard phase forming powder, the hardness of the hard phase forming powder is decreased. Therefore, C is added to the hard phase forming powder at 0.25 to 2.4 mass %. If the amount of C included in the hard phase forming powder is less than 0.25 mass %, the effect for decreasing the hardness of the hard phase forming powder is not sufficiently obtained. On the other hand, if greater than 2.4 mass % of C is included in the hard phase forming powder, the amount of the chromium carbides precipitated in the hard phase forming powder comes to be too large, whereby the hardness of the hard phase forming powder is increased.

When the hard phase forming powder having the above composition is used, since the amount of the hard phase forming powder is 2 to 15 mass %, the amount of Cr in the overall composition comes to 0.08 to 3.75 mass %. In this case, the amount of C added by the hard phase forming powder corresponds to 0.005 to 0.36 mass % in the overall composition. This amount is added to the amount of C which is added to the raw powder in the form of a graphite powder. The graphite powder will be described hereinafter.

Hard Phase (B)

The hard phase (B) has the composition of the hard phase (A) and further includes at least one of 0.3 to 3.0 mass % of Mo and 0.2 to 2.2% of V. In the hard phase (B), in addition to the chromium carbides, molybdenum carbides, vanadium carbides, and complex carbides thereof are dispersed, whereby the wear resistance is further improved. In this case, the overall composition further includes at least one of 0.006 to 0.45 mass % of Mo and 0.004 to 0.33 mass % of V. This hard phase (B) is formed by adding at least one of 0.3 to 3.0 mass % of Mo and 0.2 to 2.2% of V to the hard phase forming powder of the hard phase (A).

Each of the Mo and V added to the hard phase forming powder combines with C in the hard phase forming powder and also combines with C added in the form of the graphite powder. Therefore, each of the Mo and V forms and precipitates molybdenum carbides, vanadium carbides, complex carbides of chromium and molybdenum, and complex carbides of chromium and vanadium, respectively, in the iron-chromium alloy matrix of the hard phase. In a case of adding both Mo and V, complex carbides of molybdenum and vanadium and complex carbides of chromium, molybdenum, and vanadium are also formed and are precipitated in the iron-chromium alloy matrix of the hard phase. Accordingly, in addition to the chromium carbides, Mo and V improve the wear resistance. Since the vanadium carbides are fine, the vanadium carbides prevent coarsening of the chromium carbides, whereby wear of a valve stem will be further decreased.

Each of the Mo and V, which does not form carbides, is solid-solved in the hard phase, thereby improving high-temperature hardness and high-temperature strength of the hard phase. In the hard phase forming powder, if the amount of Mo is less than 0.3 mass %, and the amount of V is less than 0.2 mass %, the above effects are not sufficiently obtained. On the other hand, if the amount of Mo is greater than 3.0 mass %, and the amount of V is greater than 2.2 mass %, too much of the carbides are precipitated, whereby wear of a valve stem will be accelerated.

Hard Phase (C)

The hard phase (C) includes hard particles made of molybdenum carbides, vanadium carbides, tungsten carbides, chromium carbides, and complex carbides thereof and has an alloy matrix made of an iron-based alloy. As the hard phase forming powder, a hard phase forming powder consisting of, by mass %, 4 to 8% of Mo, 0.5 to 3% of V, 4 to 8% of W, 2 to 6% of Cr, 0.6 to 1.2% of C, and the balance of Fe and inevitable impurities is used. Therefore, a hard phase, in which the above carbides are dispersed in an iron-based alloy matrix, is formed.

Each of the Mo, V, W, and Cr added to the hard phase forming powder combines with C in the hard phase forming powder and also combines with C added in the form of the graphite powder. Therefore, each of the Mo, V, W, and Cr precipitates molybdenum carbides, vanadium carbides, tungsten carbides, chromium carbides, and complex carbides thereof, respectively, in the iron-based alloy matrix of the hard phase. Accordingly, Mo, V, W, and Cr improve the wear resistance. Elements, that do not form carbides, are solid-solved in the hard phase, thereby improving high-temperature hardness and high-temperature strength of the hard phase. On the other hand, if the amounts of these elements are too large, too much of the carbides are precipitated, whereby wear of a valve stem will be accelerated. Therefore, the composition of the hard phase forming powder is set to include, by mass %, 4 to 8% of Mo, 0.5 to 3% of V, 4 to 8% of W, 2 to 6% of Cr, and 0.6 to 1.2% of C.

When the hard phase forming powder having the above composition is used, since the amount of the hard phase forming powder is 2 to 15 mass %, the overall composition includes 0.08 to 1.2 mass % of Mo, 0.01 to 0.45 mass % of V, 0.08 to 1.2 mass % of W, and 0.04 to 0.9 mass % of Cr. In this case, the amount of C added by the hard phase forming powder corresponds to 0.012 to 0.18 mass % in the overall composition. This amount is added to the amount of C which is added to the raw powder in the form of a graphite powder. The graphite powder will be described hereinafter.

Hard Phase (D)

The hard phase (D) includes hard particles made of molybdenum silicides and has an alloy matrix made of an iron-based alloy. As the hard phase forming powder, a hard phase forming powder consisting of, by mass %, 0.5 to 10% of Si, 10 to 50% of Mo, and the balance of Fe and inevitable impurities is used. Therefore, a hard phase, in which molybdenum silicides are dispersed in an iron-based alloy matrix, is formed.

Mo included in the hard phase forming powder reacts with the Si which is also included in the hard phase forming powder. As a result, Mo forms molybdenum silicides having superior wear resistance and lubricating characteristics, and thereby improves the wear resistance of the sintered alloy. If the amount of Mo is less than 10 mass %, the molybdenum silicides are not sufficiently obtained, whereby the effect for improving the wear resistance is not sufficiently obtained. On the other hand, if the amount of Mo is greater than 50 mass %, the hard phase forming powder is hardened, whereby the compressibility in compacting is decreased. In this case, a brittle hard phase is formed. Therefore, a part of a sintered alloy may be chipped by impact and may function as an abrasive powder, thereby decreasing the wear resistance. Accordingly, the amount of Mo is set to be 10 to 50 mass %.

Si included in the hard phase forming powder reacts with Mo as described above. As a result, Si forms molybdenum silicides having superior wear resistance and lubricating characteristics, and thereby improves the wear resistance of the sintered alloy. If the amount of Si is less than 0.5 mass %, the molybdenum silicides are not sufficiently obtained, whereby the effect for improving the wear resistance is not sufficiently obtained. On the other hand, if the amount of Si is greater than 10 mass %, the hard phase forming powder is hardened, whereby the compressibility in compacting is decreased. In this case, Si forms an oxide layer on the surfaces of the hard phase forming powder particles and prevents the hard phase forming powder from dispersing in the powder of the base alloy steel, whereby the fixability of the hard phase is decreased. When the fixability is low, the hard phase may exfoliate by impact in use and may function as an abrasive powder, thereby decreasing the wear resistance. Therefore, the amount of Si is set to be 0.5 to 10 mass %.

For these reasons, in the hard phase forming powder, the amount of Mo is set to be 10 to 50 mass %, and the amount of Si is set to be 0.5 to 10 mass %. When the hard phase forming powder having the above composition is used, since the amount of the hard phase forming powder is 2 to 15 mass %, the overall composition includes 0.2 to 7.5 mass % of Mo and 0.01 to 1.5 mass % of Si.

Hard Phase (E)

The hard phase (E) has the composition of the hard phase (D) and further includes at least one selected from the group consisting of, by mass %, 0.5 to 10% of Cr, 0.5 to 10% of Ni, and 0.5 to 5% of Mn, whereby the wear resistance is further improved. In this case, the overall composition further includes at least one selected from the group consisting of, by mass %, 0.01 to 1.0% of Cr, 0.01 to 1.0% of Ni, and 0.01 to 0.5% of Mn.

Mn, Ni, and Cr strengthen the iron-based alloy matrix of the hard phase. By strengthening the matrix, flow and loss of the molybdenum silicides are prevented, and thereby superior wear resistance is obtained even in severe conditions. Moreover, Mn, Ni, and Cr increase the fixability of the hard phase with respect to the base alloy steel, whereby loss of the hard phase is prevented, and the wear resistance is improved.

These effects are not sufficiently obtained if the amount of Mn is less than 0.5 mass %, the amount of Cr is less than 0.5 mass %, and the amount of Ni is less than 0.5%. On the other hand, if the amounts of Mn and Cr are greater than 5 mass % and 10 mass %, respectively, each of the Mn and Cr forms an oxide layer on the surfaces of the hard phase forming powder particles and prevents the hard phase forming powder from dispersing in the powder of the base alloy steel. As a result, the fixability of the hard phase is decreased. When the fixability is low, the hard phase may exfoliate by impact in use and may function as an abrasive powder, thereby decreasing the wear resistance. If the amount of Ni is greater than 10 mass %, too much of a soft austenite phase is formed in the iron-based alloy matrix by Ni dispersed in the iron-based alloy matrix. Therefore, the strength and the wear resistance of the hard phase are decreased.

Hard Phase (F)

The hard phase (F) includes hard particles made of molybdenum silicides and has an alloy matrix made of a cobalt-based alloy. As the hard phase forming powder, a hard phase forming powder consisting of, by mass %, 1.5 to 3.5% of Si, 7 to 11% of Cr, 26 to 30% of Mo, and the balance of Co and inevitable impurities is used. Therefore, a hard phase, in which molybdenum silicides are dispersed in a cobalt-based alloy matrix, is formed.

Co is dispersed in the matrix of the sintered alloy and strongly combines the hard phase to the matrix of the sintered alloy. Moreover, Co dispersed in the matrix of the sintered alloy strengthens the matrix and improves heat resistance of the matrix and heat resistance of the matrix of the hard phase. Furthermore, some of the Co combines with Mo and Si and forms molybdenum-cobalt complex silicides, thereby improving the wear resistance.

Mo combines mainly with Si and forms hard molybdenum silicides, and some of the Mo reacts with Co and forms molybdenum-cobalt complex silicides, thereby improving the wear resistance. If the amount of Mo in the hard phase forming powder is less than 26 mass %, the silicides are not sufficiently precipitated. On the other hand, if the amount of Mo is greater than 30 mass %, a large amount of the silicides is formed, whereby wear of a mating part will be accelerated.

Si combines with Mo and Co and forms hard molybdenum silicides and molybdenum-cobalt complex silicides, thereby improving the wear resistance. If the amount of Si in the hard phase forming powder is less than 1.5 mass %, the silicides are not sufficiently precipitated. On the other hand, if the amount of Si is greater than 3.5 mass %, the hard phase forming powder is hardened, whereby the compressibility is decreased. In this case, a large amount of the silicides is formed, whereby wear of a mating part will be accelerated.

Cr is dispersed in the matrix of the sintered alloy, whereby the matrix is strengthened by solid solution strengthening, and quenchability of the matrix is improved. In addition, Cr strongly combines the hard phase to the matrix of the sintered alloy. Moreover, Cr combines with Co and forms a diffusive phase around the hard phase, whereby the degree of impact in abutting with a mating part is decreased. If the amount of Cr in the hard phase forming powder is less than 7 mass %, the above effects are not sufficiently obtained. On the other hand, if the amount of Cr is greater than 11 mass %, the hard phase forming powder is hardened, whereby the compressibility is decreased.

When the hard phase forming powder having the above composition is used, since the amount of the hard phase forming powder is 2 to 15 mass %, the overall composition includes 1.17 to 9.82 mass % of Co, 0.52 to 4.5 mass % of Mo, 0.03 to 0.525 mass % of Si, and 0.14 to 1.65 mass % of Cr.

One kind of the hard phases (A) to (F) may be dispersed in the matrix of the sintered alloy, or more than one kind of the hard phases (A) to (F) may be dispersed therein at a time. In the case of using more than one kind of the hard phases, since the above-described inconveniences are caused if the total amount of the hard phase is too large, the upper limit of the amount of the hard phase forming powder is set to be 15% as described above.

In the metallic structure of the sintered valve guide, a free graphite phase is preferably dispersed in the pores. Some of the graphite powder, which is added to the raw powder, is made to be not dispersed in the matrix and the hard phase in sintering and is made to remain in the form of graphite. As a result, some of the graphite power is dispersed in the pores as free graphite. The free graphite functions as a solid lubricant and improves the machinability and the wear resistance of the sintered alloy.

As described above, the graphite powder added to the raw powder is dispersed in the matrix of the sintered alloy and forms a pearlitic matrix and an iron-phosphorus-carbon compound phase as well as a free graphite phase. If the amount of the graphite powder in the raw powder is less than 1 mass %, the above metallic structure is not easily obtained. On the other hand, if the amount of the graphite powder is greater than 3 mass %, too much of the iron-phosphorus-carbon compound phase is formed, and a hard cementite ($Fe_3C$) is precipitated in the matrix of the sintered alloy, whereby the machinability of the sintered alloy is decreased. Moreover, an excessive amount of the graphite powder decreases the compressibility of the raw powder and causes segregation and low flowability of the raw powder. Furthermore, the ratio of the matrix of the sintered alloy is decreased, and thereby strength of the sintered alloy is decreased. Accordingly, the amount of the graphite powder in the raw powder is set to be 1 to 3 mass %.

In order to obtain the above metallic structure, the sintering is performed at a heating temperature of 950 to 1050° C. in a nonoxidizing atmosphere. If the heating temperature is lower than 950° C. in sintering, reaction in the sintering does not sufficiently proceed, and the strength of the sintered alloy will be remarkably low. On the other hand, if the heating temperature is higher than 1050° C. in sintering, the iron-phosphorus-carbon compound phase is formed with a netlike appearance, whereby the wear resistance and the machinability are decreased. Moreover, the free graphite may not be formed.

In the production method for the sintered valve guide of the present invention, a common technique of a powder metallurgical method may be used. That is, the raw powder may be filled into a tube-shaped cavity of a die assembly, the raw powder may be compacted into a green compact having a tube shape, and the green compact may be sintered.

A cross section of a metallic structure of a sintered valve guide obtained by the above-described production method is schematically shown in FIG. 1. The metallic structure is made of a matrix, pores, and a graphite phase dispersed in the pores, and the matrix includes a pearlite phase, an iron-phosphorus-carbon compound phase, a hard phase, and a copper-tin alloy phase. The hard phase is dispersed in a condition in which hard particles are concentrated in an iron-based alloy or a cobalt-based alloy. A small amount of a ferrite phase is formed around the iron-phosphorus-carbon compound phase.

In the sintered valve guide, by adding a powder of a machinability improving material to the raw powder and by dispersing the machinability improving material into the sintered alloy, the machinability of the sintered alloy is improved. As the machinability improving material, at least one kind selected from the group consisting of manganese sulfide, calcium fluoride, molybdenum disulfide, and magnesium metasilicate minerals is described. If the amount of the machinability improving material dispersed in the sintered alloy is too large, the sintering may be prevented, whereby the strength of the sintered alloy is decreased. Therefore, it is required to set the amount of the powder of the machinability improving material added to the raw powder to be not greater than 2.0 mass %, so that the amount of the machinability improving material dispersed in the sintered alloy is not greater than 2.0 mass %.

EXAMPLES

The present invention will be described in further detail with reference to practical examples hereinafter.

First Example

The effects of the amount of the hard phase forming powder on characteristics of a sintered valve guide were investigated. An atomized iron powder as an iron powder, an iron-phosphorus alloy powder consisting of 20 mass % of P and the balance of Fe and inevitable impurities, and a hard phase forming powder consisting of 12 mass % of Cr, 1.5 mass % of C, and the balance of Fe and inevitable impurities were prepared. In addition, an electrolytic copper powder as a copper powder, a copper-tin alloy powder consisting of 10 mass % of Sn and the balance of Cu and inevitable impurities, and a graphite powder were prepared. These powders were mixed at the mixing ratios shown in Table 1, whereby raw powders were obtained. The raw powders were compacted at a compacting pressure of 6.0 ton/cm$^2$ and were formed into green compacts with a tube shape. Some of the green compacts had an outer diameter of 11 mm, an inner diameter of 6 mm, and a length of 40 mm (for a wear test and a machinability test). The other green compacts had an outer diameter of 18 mm, an inner diameter of 10 mm, and a length of 10 mm (for a compressive strength test). The green compacts were sintered at 1000° C. for 60 minutes in a nonoxidizing atmosphere, whereby sintered alloy samples of samples Nos. 01 to 08 were obtained. The sample of the sample No. 08 was prepared as a conventional example and was a sintered alloy sample as disclosed in Japanese Examined Patent Publication No. 55-034858. The overall compositions of the samples are shown in Table 2.

In these samples, wear amount of a valve guide and wear amount of a valve stem were measured by the wear test, and compressive strength was measured by the compressive strength test.

The wear test was performed as follows by using a wear testing machine. The sintered alloy sample having the tube shape was secured to the wear testing machine, and a valve stem of a valve was inserted into the sintered alloy sample. The valve was mounted at a lower end portion of a piston that would be vertically reciprocated. Then, the valve was reciprocated at a stroke speed of 3000 times per minutes and at a stroke length of 8 mm at 500° C. in an exhaust gas atmosphere, and at the same time, a lateral load of 5 MPa was applied to the piston. After the valve was reciprocated for 30 hours, wear amount (in μm) of the inner circumferential surface of the sintered compact was measured.

The compressive strength test was performed as follows according to the method described in Z2507 specified by the Japanese Industrial Standard. A sintered alloy sample with a tube shape had an outer diameter of D (mm), a wall thickness of e (mm), and a length of L (mm). The sintered alloy sample was radially pressed by increasing the pressing load, and a maximum load F (N) was measured when the sintered alloy sample broke. Then, a compressive strength (N/mm$^2$) was calculated from the following first formula.

$$K=F\times(D-e)/(L\times e^2) \qquad \text{First formula}$$

These results are shown in Table 2. It should be noted that the wear amount of the valve guide is represented by the symbol "VG", and the wear amount of the valve stem is represented by the symbol "VS" in the Tables.

TABLE 1

| Sample No. | Mixing ratio mass % Iron powder | Iron-phosphorus alloy powder | Hard phase forming powder | Copper powder | Copper-tin alloy powder | Graphite powder | Notes |
|---|---|---|---|---|---|---|---|
| 01 | Balance | 1.40 | — | 7.00 | — | 2.00 | Exceeds lower limit of amount of hard phase forming powder |
| 02 | Balance | 1.40 | 1.00 | 7.00 | — | 2.00 | Exceeds lower limit of amount of hard phase forming powder |
| 03 | Balance | 1.40 | 2.00 | 7.00 | — | 2.00 | Lower limit of amount of hard phase forming powder |
| 04 | Balance | 1.40 | 5.00 | 7.00 | — | 2.00 | |
| 05 | Balance | 1.40 | 10.00 | 7.00 | — | 2.00 | |
| 06 | Balance | 1.40 | 15.00 | 7.00 | — | 2.00 | Upper limit of amount of hard phase forming powder |
| 07 | Balance | 1.40 | 20.00 | 7.00 | — | 2.00 | Exceeds upper limit of amount of hard phase forming powder |
| 08 | Balance | 1.40 | — | — | 5.00 | 2.00 | Alloy disclosed in Japanese Examined Patent Publication No. 55-034858 |

TABLE 2

| Sample | Composition mass % | | | | | | Wear amount μm | | | Compressive strength | |
|---|---|---|---|---|---|---|---|---|---|---|---|
| No. | Fe | P | Cu | Cr | C | Sn | VG | VS | Total | MPa | Notes |
| 01 | Balance | 0.28 | 7.00 | — | 2.00 | — | 69 | 1 | 70 | 672 | Exceeds lower limit of amount of hard phase forming powder |
| 02 | Balance | 0.28 | 7.00 | 0.12 | 2.02 | — | 59 | 2 | 61 | 670 | Exceeds lower limit of amount of hard phase forming powder |
| 03 | Balance | 0.28 | 7.00 | 0.24 | 2.03 | — | 52 | 1 | 53 | 659 | Lower limit of amount of hard phase forming powder |

TABLE 2-continued

| Sample | Composition mass % | | | | | | Wear amount μm | | | Compressive strength | |
|---|---|---|---|---|---|---|---|---|---|---|---|
| No. | Fe | P | Cu | Cr | C | Sn | VG | VS | Total | MPa | Notes |
| 04 | Balance | 0.28 | 7.00 | 0.60 | 2.08 | — | 44 | 3 | 47 | 643 | |
| 05 | Balance | 0.28 | 7.00 | 1.20 | 2.15 | — | 31 | 3 | 34 | 621 | |
| 06 | Balance | 0.28 | 7.00 | 1.80 | 2.23 | — | 24 | 4 | 28 | 576 | Upper limit of amount of hard phase forming powder |
| 07 | Balance | 0.28 | 7.00 | 2.40 | 2.30 | — | 37 | 14 | 51 | 512 | Exceeds upper limit of amount of hard phase forming powder |
| 08 | Balance | 0.28 | 4.50 | — | 2.00 | 0.50 | 61 | 2 | 63 | 680 | Alloy disclosed in Japanese Examined Patent Publication No. 55-034858 |

According to the sintered alloy samples of the samples Nos. 01 to 07 in Table 1 and 2, the effects of the amount of the hard phase forming powder are shown.

In the sintered alloy sample of the sample No. 01, in which the hard phase forming powder was not added and the hard phase was not dispersed, the wear amount of the valve guide was large and was greater than that of the conventional sintered alloy sample (sample No. 08). This was because the conventional sintered alloy sample (sample No. 08) included Sn and had a matrix strengthened by Sn, whereas the sintered alloy sample of the sample No. 01 did not include Sn and thereby had a matrix with lower strength and lower wear resistance. On the other hand, in the sintered alloy sample of the sample No. 02, in which the hard phase forming powder was added at 1 mass % and the hard phase was dispersed at 1 mass %, the wear amount of the valve guide was decreased. Although the sintered alloy sample of the sample No. 02 did not include Sn, the wear amount of the valve guide was approximately equal to that of the conventional sintered alloy sample (sample No. 08).

In the sintered alloy sample of the sample No. 03 in which the amount of the hard phase forming powder was 2 mass %, the wear amount of the valve guide was decreased by approximately 15%, and the wear resistance was improved. In the sintered alloy sample (samples Nos. 04 to 06) in which the hard phase forming powder was not more than 15 mass %, the wear amount of the valve guide was decreased with an increase in the amount of the hard phase forming powder.

As the amount of the hard phase forming powder was increased, the wear amount of the valve stem was slightly increased, but the wear amount of the valve guide was greatly decreased, whereby the total wear amount was decreased. As a result, the total wear amount was decreased to up to 44% of that of the conventional sintered alloy sample (sample No. 08). However, in the sintered alloy sample of the sample No. 07, in which the amount of the hard phase forming powder was more than 15 mass %, the amount of the hard phase dispersed in the sintered alloy was too large. Therefore, the wear characteristics with respect to the valve were increased, and the wear amount of the valve stem was increased. Moreover, the wear particles of the valve stem acted as an abrasive powder, whereby the wear amount of the valve guide was also increased. Accordingly, the total wear amount was remarkably increased.

In the sintered alloy sample of the sample No. 01, in which the hard phase forming powder was not added and the hard phase was not dispersed, the compressive strength was the highest. This compressive strength was slightly less than that of the conventional sintered alloy sample (sample No. 08). This was because the sintered alloy sample of the sample No. 01 did not include Sn and thereby the matrix was not strengthened as described above. In the sintered alloy sample (samples Nos. 02 to 07), in which the hard phase forming powder was added, the compressive strength was less than that of the sintered alloy sample of the sample No. 01, in which the hard phase forming powder was not added and the hard phase was not dispersed. In this case, all of the compressive strengths were decreased with increase in the amount of the hard phase forming powder. This was because the hard phase having low strength was increased, and the compressibility was decreased by the increase of the hard phase forming powder in the raw powder. In the sintered alloy sample of the sample No. 06 in which the amount of the hard phase forming powder was 15 mass %, the compressive strength was not less than 80% of that of the conventional sintered alloy sample (sample No. 08). This degree of the compressive strength was not a problem in practical use. On the other hand, in the sintered alloy sample of the sample No. 07 in which the amount of the hard phase forming powder was more than 15 mass %, the compressive strength was decreased to approximately 75% of that of the conventional sintered alloy sample (sample No. 08).

As described above, by adding the hard phase forming powder to the raw powder and by dispersing the hard phase in the sintered alloy, the wear resistance of the valve guide was improved. By adding 2 to 15 mass % of the hard phase forming powder, the wear resistance was improved to be greater than that of the conventional sintered alloy. Although the compressive strength was decreased by adding 2 to 15 mass % of the hard phase forming powder to the raw powder, the degree of the decrease in the compressive strength was not a problem in practical use.

Second Example

The effects of the amounts of Cr and C in the hard phase forming powder on the characteristics of a sintered valve guide were investigated. The iron powder, the iron-phosphorus alloy powder, the copper powder, the copper-tin alloy powder, and the graphite powder, all of which were used in the First Example, were prepared. In addition, hard phase forming powders including different amounts of Cr and C were prepared. These powders were mixed at mixing ratios shown in Table 3, and raw powders were obtained. The raw powders were formed into sintered alloy samples in the same manner as those in the First Example, whereby sintered alloy samples of samples Nos. 09 to 22 were obtained. The wear test and the compressive strength test were performed on these sintered alloy samples under the same conditions as those in the First Example, and the wear amounts and the compressive strengths were measured. The overall compositions and the test results of these samples are shown in Table 4. It should be noted that the values of the sintered alloy sample of the sample No. 05 and the values of the conventional sintered alloy sample of the sample No. 08 in the First Example are also shown in Table 3 and 4.

TABLE 3

| Sample No. | Mixing ratio mass % Iron powder | Iron-phosphorus alloy powder | Hard phase forming powder Fe | Cr | C | Copper powder | Copper-tin alloy powder | Graphite powder | Notes |
|---|---|---|---|---|---|---|---|---|---|
| 09 | Balance | 1.40 | 10.00 Balance | 2.00 | 1.50 | 7.00 | — | 2.00 | Exceeds lower limit of Cr amount in hard phase forming powder |
| 10 | Balance | 1.40 | 10.00 Balance | 4.00 | 1.50 | 7.00 | — | 2.00 | Lower limit of Cr amount in hard phase forming powder |
| 11 | Balance | 1.40 | 10.00 Balance | 8.00 | 1.50 | 7.00 | — | 2.00 | |
| 05 | Balance | 1.40 | 10.00 Balance | 12.00 | 1.50 | 7.00 | — | 2.00 | |
| 12 | Balance | 1.40 | 10.00 Balance | 16.00 | 1.50 | 7.00 | — | 2.00 | |
| 13 | Balance | 1.40 | 10.00 Balance | 20.00 | 1.50 | 7.00 | — | 2.00 | |
| 14 | Balance | 1.40 | 10.00 Balance | 25.00 | 1.50 | 7.00 | — | 2.00 | Upper limit of Cr amount in hard phase forming powder |
| 15 | Balance | 1.40 | 10.00 Balance | 30.00 | 1.50 | 7.00 | — | 2.00 | Exceeds upper limit of Cr amount in hard phase forming powder |
| 16 | Balance | 1.40 | 10.00 Balance | 12.00 | 0.10 | 7.00 | — | 2.00 | Exceeds lower limit of C amount in hard phase forming powder |
| 17 | Balance | 1.40 | 10.00 Balance | 12.00 | 0.25 | 7.00 | — | 2.00 | Lower limit of C amount in hard phase forming powder |
| 18 | Balance | 1.40 | 10.00 Balance | 12.00 | 0.50 | 7.00 | — | 2.00 | |
| 19 | Balance | 1.40 | 10.00 Balance | 12.00 | 1.00 | 7.00 | — | 2.00 | |
| 05 | Balance | 1.40 | 10.00 Balance | 12.00 | 1.50 | 7.00 | — | 2.00 | |
| 20 | Balance | 1.40 | 10.00 Balance | 12.00 | 2.00 | 7.00 | — | 2.00 | |
| 21 | Balance | 1.40 | 10.00 Balance | 12.00 | 2.40 | 7.00 | — | 2.00 | Upper limit of C amount in hard phase forming powder |
| 22 | Balance | 1.40 | 10.00 Balance | 12.00 | 2.60 | 7.00 | — | 2.00 | Exceeds upper limit of C amount in hard phase forming powder |
| 08 | Balance | 1.40 | — | | | — | 5.00 | 2.00 | Alloy disclosed in Japanese Examined Patent Publication No. 55-034858 |

TABLE 4

| Sample No. | Composition mass % Fe | P | Cu | Cr | C | Sn | Wear amount μm VG | VS | Total | Compressive strength MPa | Notes |
|---|---|---|---|---|---|---|---|---|---|---|---|
| 09 | Balance | 0.28 | 7.00 | 0.20 | 2.15 | — | 60 | 2 | 62 | 582 | Exceeds lower limit of Cr amount in hard phase forming powder |
| 10 | Balance | 0.28 | 7.00 | 0.40 | 2.15 | — | 48 | 2 | 50 | 593 | Lower limit of Cr amount in hard phase forming powder |
| 11 | Balance | 0.28 | 7.00 | 0.80 | 2.15 | — | 37 | 1 | 38 | 608 | |
| 05 | Balance | 0.28 | 7.00 | 1.20 | 2.15 | — | 31 | 3 | 34 | 621 | |
| 12 | Balance | 0.28 | 7.00 | 1.60 | 2.15 | — | 26 | 4 | 30 | 614 | |
| 13 | Balance | 0.28 | 7.00 | 2.00 | 2.15 | — | 24 | 4 | 28 | 603 | |
| 14 | Balance | 0.28 | 7.00 | 2.50 | 2.15 | — | 25 | 7 | 32 | 591 | Upper limit of Cr amount in hard phase forming powder |
| 15 | Balance | 0.28 | 7.00 | 3.00 | 2.15 | — | 41 | 11 | 52 | 565 | Exceeds upper limit of Cr amount |
| 16 | Balance | 0.28 | 7.00 | 1.20 | 2.01 | — | 59 | 2 | 61 | 580 | Exceeds lower limit of C amount in hard phase forming powder |
| 17 | Balance | 0.28 | 7.00 | 1.20 | 2.03 | — | 46 | 2 | 48 | 600 | Lower limit of C amount in hard phase forming powder |
| 18 | Balance | 0.28 | 7.00 | 1.20 | 2.05 | — | 41 | 3 | 44 | 613 | |
| 19 | Balance | 0.28 | 7.00 | 1.20 | 2.10 | — | 37 | 2 | 39 | 622 | |
| 05 | Balance | 0.28 | 7.00 | 1.20 | 2.15 | — | 31 | 3 | 34 | 621 | |
| 20 | Balance | 0.28 | 7.00 | 1.20 | 2.20 | — | 27 | 3 | 30 | 597 | |
| 21 | Balance | 0.28 | 7.00 | 1.20 | 2.24 | — | 31 | 5 | 36 | 576 | Upper limit of C amount in hard phase forming powder |
| 22 | Balance | 0.28 | 7.00 | 1.20 | 2.26 | — | 44 | 9 | 53 | 552 | Exceeds upper limit of C amount in hard phase forming powder |
| 08 | Balance | 0.28 | 4.50 | — | 2.00 | 0.50 | 61 | 2 | 63 | 680 | Alloy disclosed in Japanese Examined Patent Publication No. 55-034858 |

According to the sintered alloy samples of the samples Nos. 05 and 09 to 15 in Table 3 and 4, the effects of the amount of Cr in the hard phase forming powder are shown.

In the sintered alloy sample of the sample No. 09 in which the amount of Cr in the hard phase forming powder was 2 mass % and the amount of Cr in the overall composition was 0.2 mass %, the wear amount of the valve guide was approximately equal to that of the conventional sintered alloy sample (sample No. 08). On the other hand, in the sintered alloy sample of the sample No. 10 in which the amount of Cr in the hard phase forming powder was 4 mass % and the amount of Cr in the overall composition was 0.4 mass %, the chromium carbides were sufficiently precipitated in the hard phase, whereby the wear resistance of the sintered alloy was improved. As a result, the wear amount of the valve guide was decreased by 20% compared to that of the conventional sintered alloy sample (sample No. 08). In the sintered alloy sample (samples Nos. 10, 11, 05, 12, and 13) in which the amount of Cr in the hard phase forming powder was not more than 20 mass % (the amount of Cr in the overall composition was not more than 2 mass %), as the amount of Cr was increased, the amount of the chromium carbides dispersed in the hard phase was increased, whereby the wear amount of the valve guide was decreased.

As the amount of Cr in the hard phase forming powder was increased, since the amount of the hard chromium carbides precipitated in the hard phase was increased, the wear amount of the valve stem was slightly increased. However, the total wear amount was decreased to up to approximately 45% of that of the conventional sintered alloy sample (sample No. 08) because the wear amount of the valve guide was greatly decreased. When the amount of Cr in the hard phase forming powder was further increased, according to the sintered alloy sample of the sample No. 14 in which the amount of Cr was 25 mass % (the amount of Cr in the overall composition was 2.5 mass %), the total wear amount was slightly increased. This was because the amount of the chromium carbides precipitated in the hard phase was increased and thereby the wear amount of the valve stem was slightly increased, whereas the wear amount of the valve guide was decreased. In the sintered alloy sample of the sample No. 15 in which the amount of Cr in the hard phase forming powder was more than 25 mass % (the amount of Cr in the overall composition was more than 2.5 mass %), the amount of the chromium carbides precipitated in the hard phase was too large. Therefore, the wear amount of the valve stem was increased, and the wear amount of the valve guide was also increased because the wear particles of the valve stem acted as an abrasive powder. Accordingly, the total wear amount was remarkably increased.

As the amount of Cr in the hard phase forming powder was increased, the amount of Cr dispersed from the hard phase forming powder to the matrix of the sintered alloy was increased, whereby the matrix was strengthened. Therefore, the compressive strength was increased while the amount of Cr in the hard phase forming powder was not more than 12 mass % (the amount of Cr in the overall composition was not more than 1.2 mass %) (samples Nos. 09 to 11, and 05). On the other hand, when the amount of Cr in the hard phase forming powder was more than 12 mass % (the amount of Cr in the overall composition was more than 1.2 mass %) (samples Nos. 12 to 15), the compressive strength was decreased. In this case, the amount of Cr in the hard phase forming powder was large, whereby the hardness of the hard phase forming powder was increased. Therefore, the compressibility of the raw powder was decreased, and the green compact density was decreased. As a result, the density of the sintered alloy was decreased, and the strength of the sintered alloy was decreased. In the sample of the sample No. 15 in which the amount of Cr in the hard phase forming powder was more than 25 mass % (the amount of Cr in the overall composition was more than 2.5 mass %), the compressive strength was not less than 80% of that of the conventional sintered alloy sample (sample No. 08).

As described above, when the amount of Cr in the hard phase forming powder was in the range of 4 to 25 mass %, and the amount of Cr in the overall composition was in the range of 0.4 to 2.5 mass %, the wear resistance was improved, and the degree of the compressive strength was not a problem in practical use.

According to the sintered alloy samples of the samples Nos. 05 and 16 to 22 in Table 3 and 4, the effects of C in the hard phase forming powder are shown.

In the sintered alloy sample of the sample No. 16 in which the amount of C in the hard phase forming powder was 0.1 mass %, the wear amount of the valve guide was large. This was because the amount of C in the hard phase forming powder was small, and thereby the amount of the chromium carbides precipitated in the hard phase forming powder was small. On the other hand, in the sintered alloy sample of the sample No. 17 in which the amount of C in the hard phase forming powder was 0.25 mass %, the amount of the chromium carbides precipitated in the hard phase was increased. Therefore, the wear resistance of the sintered alloy was improved, and the wear amount of the valve guide was decreased by approximately 25% compared to that of the conventional sintered alloy sample (sample No. 08). In the sintered alloy sample (samples Nos. 18, 19, 05, and 20) in which the amount of C in the hard phase forming powder was not more than 2 mass %, the wear amount of the valve guide was decreased. This was because the amount of the chromium carbides dispersed in the hard phase was increased with increase in the amount of C in the hard phase forming powder.

As the amount of C in the hard phase forming powder was increased, since the amount of the hard chromium carbides precipitated in the hard phase was increased, the wear amount of the valve stem was slightly increased. However, the total wear amount was decreased to up to approximately 50% of that of the conventional sintered alloy sample (sample No. 08) because the wear amount of the valve guide was greatly decreased. When the amount of C in the hard phase forming powder was further increased, according to the sintered alloy sample of the sample No. 21 in which the amount of C in the hard phase forming powder was 2.4 mass %, the hard phase forming powder was hardened. Therefore, the compressibility of the raw powder was decreased, and the green compact density was decreased. As a result, the density of the sintered compact was decreased, and the strength of the sintered alloy was decreased, whereby the wear amount of the valve guide was increased. Moreover, the amount of the chromium carbides precipitated in the hard phase was increased, whereby, the wear amount of the valve stem was slightly increased. Accordingly, the total wear amount was slightly increased. In the sintered alloy sample of the sample No. 22 in which the amount of C in the hard phase forming powder was more than 2.4 mass %, the amount of the chromium carbides precipitated in the hard phase was too large. Therefore, the wear amount of the valve stem was increased, and the wear amount of the valve guide was also increased because the wear particles of the valve stem acted as an abrasive powder. Accordingly, the total wear amount was remarkably increased.

In the sintered alloy sample of the sample No. 16 in which the amount of C in the hard phase forming powder was 0.1 mass %, the reason for the increase in the wear amount of the valve guide may be further described as follows. That is, when the amount of C was 0.1 mass %, the amount of C was small compared with the amount of Cr in the hard phase forming powder. Therefore, the amount of Cr solid-solved in the matrix of the hard phase forming powder was increased, whereby the hard phase forming powder was hardened. Accordingly, the compressibility of the raw powder was decreased.

When the amount of C in the hard phase forming powder was increased, the amount of the chromium carbides precipitated in the hard phase forming powder was increased, and the amount of Cr solid-solved in the matrix of the hard phase forming powder was decreased. Therefore, the hardness of the matrix of the hard phase forming powder was decreased. In the sintered alloy sample (samples Nos. 17 to 19) in which the amount of C in the hard phase forming powder was not more than 1 mass %, the effect for decreasing the hardness of the powder due to the decrease in the amount of Cr solid-solved in the matrix of the powder was great. Therefore, the hardness of the hard phase forming powder was decreased, and the compressibility of the raw powder was improved. Accordingly, the green compact density was increased, whereby the compressive strength was increased.

On the other hand, in the sintered alloy sample (samples Nos. 05 and 20 to 22) in which the amount of C in the hard phase forming powder was more than 1 mass %, the effect for increasing the hardness of the powder due to the chromium carbides was greater than the effect for decreasing the hardness of the powder due to the decrease in the amount of Cr solid-solved in the matrix. This was because the amount of the hard chromium carbides precipitated in the powder was increased with the increase in the amount of C in the hard phase forming powder. Therefore, the hardness of the hard phase forming powder was increased, whereby the compressibility of the raw powder was decreased. Accordingly, the compressive strength was decreased with the increase in the amount of C in the hard phase forming powder. In this case, when the amount of C in the hard phase forming powder was not more than 2.4 mass %, the compressive strength was not less than 80% of that of the conventional sintered alloy sample (sample No. 08) and reached a practical level.

As described above, when the amount of C in the hard phase forming powder was in the range of 0.25 to 2.4 mass %, the wear resistance was improved, and the degree of the compressive strength was not a problem in practical use.

Third Example

The effects of the amounts of Mo and V in the hard phase forming powder on the characteristics of a sintered valve guide were investigated. The iron powder, the iron-phosphorus alloy powder, the copper powder, the copper-tin alloy powder, and the graphite powder, all of which were used in the First Example, were prepared. In addition, hard phase forming powders having compositions shown in Table 5 were prepared. These powders were mixed at mixing ratios shown in Table 5 and raw powders were obtained. The raw powders were formed into sintered alloy samples in the same manner as those in the First Example, whereby sintered alloy samples of the samples Nos. 23 to 30 were obtained. The wear test and the compressive strength test were performed on these sintered alloy samples under the same conditions as those in the First Example, and the wear amounts and the compressive strengths were measured. The overall compositions and the test results of these samples are shown in Table 6. It should be noted that the values of the sintered alloy sample of the sample No. 05 and the values of the conventional sintered alloy sample of the sample No. 08 in the First Example are also shown in Table 6.

TABLE 5

| | Mixing ratio mass % | | | | | | | | | | |
|---|---|---|---|---|---|---|---|---|---|---|---|
| Sample | Iron | Iron-phosphorus | Hard phase forming powder | | | | | Copper | Copper-tin alloy | Graphite | |
| No. | powder | alloy powder | Fe | Cr | C | Mo | V | powder | powder | powder | Notes |
| 05 | Balance | 1.40 | 10.00 Balance | 12.00 | 1.50 | — | — | 7.00 | — | 2.00 | |
| 23 | Balance | 1.40 | 10.00 Balance | 12.00 | 1.50 | 0.30 | — | 7.00 | — | 2.00 | Lower limit of Mo amount in hard phase forming powder |
| 24 | Balance | 1.40 | 10.00 Balance | 12.00 | 1.50 | 1.50 | — | 7.00 | — | 2.00 | |
| 25 | Balance | 1.40 | 10.00 Balance | 12.00 | 1.50 | 3.00 | — | 7.00 | — | 2.00 | Upper limit of Mo amount in hard phase forming powder |
| 26 | Balance | 1.40 | 10.00 Balance | 12.00 | 1.50 | 5.00 | — | 7.00 | — | 2.00 | Exceeds upper limit of Mo amount in hard phase forming powder |
| 05 | Balance | 1.40 | 10.00 Balance | 12.00 | 1.50 | — | — | 7.00 | — | 2.00 | |
| 27 | Balance | 1.40 | 10.00 Balance | 12.00 | 1.50 | — | 0.20 | 7.00 | — | 2.00 | Lower limit of V amount in hard phase forming powder |
| 28 | Balance | 1.40 | 10.00 Balance | 12.00 | 1.50 | — | 1.50 | 7.00 | — | 2.00 | |
| 29 | Balance | 1.40 | 10.00 Balance | 12.00 | 1.50 | — | 2.20 | 7.00 | — | 2.00 | Upper limit of V amount in hard phase forming powder |
| 30 | Balance | 1.40 | 10.00 Balance | 12.00 | 1.50 | — | 4.00 | 7.00 | — | 2.00 | Exceeds upper limit of V amount in hard phase forming powder |
| 08 | Balance | 1.40 | — | | | | | — | 5.00 | 2.00 | Alloy disclosed in Japanese Examined Patent Publication No. 55-034858 |

TABLE 6

| Sample | Composition mass % | | | | | | | | Wear amount μm | | | Compressive strength | |
|---|---|---|---|---|---|---|---|---|---|---|---|---|---|
| No. | Fe | P | Cu | Cr | C | Mo | V | Sn | VG | VS | Total | MPa | Notes |
| 05 | Balance | 0.28 | 7.00 | 1.20 | 2.15 | 0.00 | — | — | 31 | 3 | 34 | 621 | |
| 23 | Balance | 0.28 | 7.00 | 1.20 | 2.15 | 0.03 | — | — | 27 | 3 | 30 | 618 | Lower limit of Mo amount in hard phase forming powder |
| 24 | Balance | 0.28 | 7.00 | 1.20 | 2.15 | 0.15 | — | — | 24 | 3 | 27 | 612 | |
| 25 | Balance | 0.28 | 7.00 | 1.20 | 2.15 | 0.30 | — | — | 26 | 4 | 30 | 602 | Upper limit of Mo amount in hard phase forming powder |
| 26 | Balance | 0.28 | 7.00 | 1.20 | 2.15 | 0.50 | — | — | 40 | 9 | 49 | 579 | Exceeds upper limit of Mo amount in hard phase forming powder |
| 05 | Balance | 0.28 | 7.00 | 1.20 | 2.15 | — | 0.00 | — | 31 | 3 | 34 | 621 | |
| 27 | Balance | 0.28 | 7.00 | 1.20 | 2.15 | — | 0.02 | — | 28 | 2 | 30 | 617 | Lower limit of V amount in hard phase forming powder |
| 28 | Balance | 0.28 | 7.00 | 1.20 | 2.15 | — | 0.15 | — | 24 | 2 | 26 | 609 | |
| 29 | Balance | 0.28 | 7.00 | 1.20 | 2.15 | — | 0.22 | — | 27 | 4 | 31 | 600 | Upper limit of V amount in hard phase forming powder |
| 30 | Balance | 0.28 | 7.00 | 1.20 | 2.15 | — | 0.40 | — | 42 | 8 | 50 | 581 | Exceeds upper limit of V amount in hard phase forming powder |
| 08 | Balance | 0.28 | 4.50 | — | 2.00 | — | — | 0.50 | 61 | 2 | 63 | 680 | Alloy disclosed in Japanese Examined Patent Publication No. 55-034858 |

According to the sintered alloy samples of the samples Nos. 05 and 23 to 26 in Table 5 and 6, the effects of adding Mo to the hard phase forming powder are shown.

Compared to the sintered alloy sample of the sample No. 05 which did not include Mo in the hard phase forming powder, in the sintered alloy samples of the samples Nos. 23 to 25 in which the amount of Mo in the hard phase forming powder was 0.3 to 3 mass %, not only the chromium carbides but also the molybdenum carbides were precipitated in the hard phase. Therefore, the wear resistances of the sintered alloys were improved, whereby the wear amounts of the valve guides were decreased, and the total wear amounts were also decreased. On the other hand, when the amount of Mo in the hard phase forming powder was more than 3 mass %, the amount of the carbides in the hard phase was too large. Therefore, the wear amount of the valve stem was increased, and the wear amount of the valve guide was also increased because the wear particles of the valve stem acted as an abrasive powder. As a result, the total wear amount was remarkably increased.

Compared to the sintered alloy sample of the sample No. 05 which did not include Mo in the hard phase forming powder, the compressive strength was decreased by adding Mo in the hard phase forming powder and was decreased with the increase in the amount of Mo. In this case, when the amount of Mo was in the above test range, the compressive strength was not less than 80% of that of the conventional sintered alloy sample (sample No. 08) and reached a practical level.

As described above, by adding 0.3 to 3 mass % of Mo to the hard phase forming powder, the wear resistance of the sintered alloy was more improved, and the degree of the compressive strength was not a problem in practical use.

According to the sintered alloy samples of the samples Nos. 05 and 27 to 30 in Table 5 and 6, the effects of adding V to the hard phase forming powder are shown.

Compared to the sintered alloy sample of the sample No. 05 which did not include V in the hard phase forming powder, in the sintered alloy samples of the samples Nos. 27 to 29 in which the amount of V in the hard phase forming powder was 0.2 to 2.2 mass %, not only the chromium carbides but also the vanadium carbides were precipitated in the hard phase. Therefore, the wear resistances of the sintered alloys were improved, whereby the wear amounts of the valve guides were decreased, and the total wear amounts were also decreased. On the other hand, when the amount of V in the hard phase forming powder was more than 2.2 mass %, the amount of the carbides in the hard phase was too large. Therefore, the wear amount of the valve stem was increased, and the wear amount of the valve guide was also increased because the wear particles of the valve stem acted as an abrasive powder. As a result, the total wear amount was remarkably increased.

Compared to the sintered alloy sample of the sample No. 05 which did not include V in the hard phase forming powder, the compressive strength was decreased by adding V in the hard phase forming powder and was decreased with the increase in the amount of V. In this case, when the amount of V was in the above test range, the compressive strength was not less than 80% of that of the conventional sintered alloy sample (sample No. 08) and reached a practical level.

As described above, by adding 0.2 to 2.2 mass % of V to the hard phase forming powder, the wear resistance of the sintered alloy was more improved, and the degree of the compressive strength was not a problem in practical use.

Fourth Example

The effect of the amount of the graphite powder on the characteristics of a sintered valve guide was investigated. The iron powder, the iron-phosphorus alloy powder, the hard phase forming powder, the copper powder, the copper-tin alloy powder, and the graphite powder, all of which were used in the First Example, were prepared. These powders were mixed at mixing ratios shown in Table 7, and raw powders were obtained. The raw powders were formed into sintered alloy samples in the same manner as those in the First Example, whereby sintered alloy samples of the samples Nos. 31 to 36 were obtained. The wear test and the compressive strength test were performed on these sintered alloy samples under the same conditions as those in the First Example, and the wear amounts and the compressive strengths were measured. The overall compositions and the test results of these samples are shown in Table 8. It should be noted that the values of the sintered alloy sample of the sample No. 05 and the values of the conventional sintered alloy sample of the sample No. 08 in the First Example are also shown in Table 8.

TABLE 7

| Sample No. | Mixing ratio mass % Iron powder | Iron-phosphorus alloy powder | Hard phase forming powder | Copper powder | Copper-tin alloy powder | Graphite powder | Notes |
|---|---|---|---|---|---|---|---|
| 31 | Balance | 1.40 | 10.00 | 7.00 | — | 0.50 | Exceeds lower limit of graphite amount in hard phase forming powder |
| 32 | Balance | 1.40 | 10.00 | 7.00 | — | 1.00 | Lower limit of graphite amount in hard phase forming powder |
| 33 | Balance | 1.40 | 10.00 | 7.00 | — | 1.50 | |
| 05 | Balance | 1.40 | 10.00 | 7.00 | — | 2.00 | |
| 34 | Balance | 1.40 | 10.00 | 7.00 | — | 2.50 | |
| 35 | Balance | 1.40 | 10.00 | 7.00 | — | 3.00 | Upper limit of graphite amount in hard phase forming powder |
| 36 | Balance | 1.40 | 10.00 | 7.00 | — | 3.50 | Exceeds upper limit of graphite amount in hard phase forming powder |
| 08 | Balance | 1.40 | — | — | 5.00 | 2.00 | Alloy disclosed in Japanese Examined Patent Publication No. 55-034858 |

TABLE 8

| Sample No. | Composition mass % Fe | P | Cu | Cr | C | Sn | Wear amout μm VG | VS | Total | Compressive strength MPa | Notes |
|---|---|---|---|---|---|---|---|---|---|---|---|
| 31 | Balance | 0.28 | 7.00 | 1.20 | 0.65 | — | 68 | 1 | 69 | 705 | Exceeds lower limit of graphite amount in hard phase forming powder |
| 32 | Balance | 0.28 | 7.00 | 1.20 | 1.15 | — | 53 | 2 | 55 | 682 | Lower limit of graphite amount in hard phase forming powder |
| 33 | Balance | 0.28 | 7.00 | 1.20 | 1.65 | — | 39 | 2 | 41 | 651 | |
| 05 | Balance | 0.28 | 7.00 | 1.20 | 2.15 | — | 31 | 3 | 34 | 621 | |
| 34 | Balance | 0.28 | 7.00 | 1.20 | 2.65 | — | 26 | 4 | 30 | 585 | |
| 35 | Balance | 0.28 | 7.00 | 1.20 | 3.15 | — | 30 | 8 | 38 | 546 | Upper limit of graphite amount in hard phase forming powder |
| 36 | Balance | 0.28 | 7.00 | 1.20 | 3.65 | — | 38 | 10 | 48 | 440 | Exceeds upper limit of graphite amount in hard phase forming powder |
| 08 | Balance | 0.28 | 4.50 | — | 2.00 | 0.50 | 61 | 2 | 63 | 680 | Alloy disclosed in Japanese Examined Patent Publication No. 55-034858 |

According to the sintered alloy samples of the samples Nos. 05 and 31 to 36 in Table 7 and 8, the effects of the amount of the graphite powder are shown.

In the sintered alloy sample of the sample No. 31 in which the amount of the graphite powder was 0.5 mass %, the amount of the graphite powder was insufficient, whereby the iron-phosphorus-carbon compound phase was not sufficiently formed in the matrix, and free graphite did not sufficiently remain in the pores. Therefore, the wear amount of the valve guide was large and was greater than that of the conventional sintered alloy sample (sample No. 08). On the other hand, in the sintered alloy sample of the sample No. 32 in which the amount of the graphite powder was 1 mass %, the iron-phosphorus-carbon compound phase was sufficiently formed in the matrix, and free graphite sufficiently remained in the pores. Therefore, the wear resistance of the sintered alloy was improved, and the wear amount of the valve guide was less than that of the conventional sintered alloy sample (sample No. 08).

As the amount of the graphite powder was increased, the amount of the iron-phosphorus-carbon compound phase formed in the matrix and the amount of the free graphite remaining in the pores were increased. Therefore, in the sintered alloy sample (samples Nos. 33, 05, and 34) in which the amount of the graphite powder was not greater than 2.5 mass %, the wear amount of the valve guide was decreased. As the amount of the graphite powder was increased, the wear amount of the valve stem slightly increased, but the wear amount of the valve guide greatly decreased, whereby the total wear amount was decreased. As a result, the total wear amount was decreased to up to approximately half of that of the conventional sintered alloy sample (sample No. 08).

When the amount of the graphite powder was further increased, according to the sintered alloy sample (sample No. 35) in which the amount of the graphite powder was 3 mass %, the amount of the iron-phosphorus-carbon compound phase and the amount of the chromium carbides precipitated in the hard phase were increased. Therefore, the strength of the matrix of the sintered alloy was decreased, whereby the wear amount of the valve guide was increased. In addition, the wear characteristics with respect to the valve stem were increased, whereby the wear amount of the valve stem was increased. In the sintered alloy sample (sample No. 36) in which the amount of the graphite powder was more than 3 mass %, the amount of the iron-phosphorus-carbon compound phase and the amount of the chromium carbides precipitated in the hard phase were too large. Therefore, the strength of the matrix of the sintered alloy was remarkably decreased, whereby the wear amount of the valve guide was increased. In addition, the wear characteristics with respect to the valve stem were increased, whereby the wear amount of the valve stem was further increased.

In the sintered alloy sample of the sample No. 31 in which the amount of the graphite powder was 0.5 mass %, the compressive strength was high. The compressive strength was decreased with the increase in the amount of the graphite powder. In this case, in the sintered alloy sample (sample No. 35) in which the amount of the graphite powder was 3 mass %, the compressive strength was approximately 80% of that of the conventional sintered alloy sample (sample No. 08) and reached a practical level. On the other hand, in the sintered alloy sample (sample No. 36) in which the amount of the graphite powder was more than 3 mass %, the compressive strength was remarkably decreased.

As described above, when the amount of the graphite powder was in the range of 1 to 3 mass %, the wear resistance of the valve guide was improved, and the degree of the compressive strength was not a problem in practical use.

Fifth Example

The effects of the amount of the copper powder on the characteristics of a sintered valve guide were investigated. The iron powder, the iron-phosphorus alloy powder, the hard phase forming powder, the copper powder, the copper-tin alloy powder, and the graphite powder, all of which were used in the First Example, were prepared. These powders were mixed at mixing ratios shown in Table 9, and raw powders were obtained. The raw powders were formed into sintered alloy samples in the same manner as those in the First Example, whereby sintered alloy samples of the samples Nos. 37 to 42 were obtained. The wear test and the compressive strength test were performed on these sintered alloy samples under the same conditions as those in the First Example, and the wear amounts and the compressive strengths were measured. The overall compositions and the test results of these samples are shown in Table 10. It should be noted that the values of the sintered alloy sample of the sample No. 05 and the values of the conventional sintered alloy sample of the sample No. 08 in the First Example are also shown in Table 10.

TABLE 9

| | Mixing ratio mass % | | | | | | |
|---|---|---|---|---|---|---|---|
| Sample No. | Iron powder | Iron-phosphorus alloy powder | Hard phase forming powder | Copper powder | Copper-tin alloy powder | Graphite powder | Notes |
| 37 | Balance | 1.40 | 10.00 | — | — | 2.00 | Exceeds lower limit of Cu amount in hard phase forming powder |
| 38 | Balance | 1.40 | 10.00 | 1.50 | — | 2.00 | Exceeds lower limit of Cu amount in hard phase forming powder |
| 39 | Balance | 1.40 | 10.00 | 3.00 | — | 2.00 | Lower limit of Cu amount in hard phase forming powder |
| 40 | Balance | 1.40 | 10.00 | 5.00 | — | 2.00 | |
| 05 | Balance | 1.40 | 10.00 | 7.00 | — | 2.00 | |
| 41 | Balance | 1.40 | 10.00 | 10.00 | — | 2.00 | Upper limit of Cu amount in hard phase forming powder |
| 42 | Balance | 1.40 | 10.00 | 12.00 | — | 2.00 | Exceeds upper limit of Cu amount in hard phase forming powder |
| 08 | Balance | 1.40 | — | — | 5.00 | 2.00 | Alloy disclosed in Japanese Examined Patent Publication No. 55-034858 |

TABLE 10

| Sample | Composition mass % | | | | | | Wear amount μm | | | Compressive strength | |
|---|---|---|---|---|---|---|---|---|---|---|---|
| No. | Fe | P | Cu | Cr | C | Sn | VG | VS | Total | MPa | Notes |
| 37 | Balance | 0.28 | — | 1.20 | 2.15 | — | 47 | 2 | 49 | 401 | Exceeds lower limit of Cu amount in hard phase forming powder |
| 38 | Balance | 0.28 | 1.50 | 1.20 | 2.15 | — | 42 | 2 | 44 | 446 | Exceeds lower limit of Cu amount in hard phase forming powder |
| 39 | Balance | 0.28 | 3.00 | 1.20 | 2.15 | — | 38 | 3 | 41 | 527 | Lower limit of Cu amount in hard phase forming powder |
| 40 | Balance | 0.28 | 5.00 | 1.20 | 2.15 | — | 33 | 2 | 35 | 578 | |
| 05 | Balance | 0.28 | 7.00 | 1.20 | 2.15 | — | 31 | 2 | 33 | 621 | |
| 41 | Balance | 0.28 | 10.00 | 1.20 | 2.15 | — | 30 | 2 | 32 | 648 | Upper limit of Cu amount in hard phase forming powder |
| 42 | Balance | 0.28 | 12.00 | 1.20 | 2.15 | — | 29 | 2 | 31 | 651 | Exceeds upper limit of Cu amount in hard phase forming powder |
| 08 | Balance | 0.28 | 4.50 | — | 2.00 | 0.50 | 61 | 2 | 63 | 680 | Alloy disclosed in Japanese Examined Patent Publication No. 55-034858 |

According to the sintered alloy samples of the samples Nos. 05 and 37 to 42 in Table 9 and 10, the effects of the amount of the copper powder are shown.

In the sintered alloy sample of the sample No. 37 which did not include the copper powder, the iron-phosphorus-carbon compound phase, the hard phase, and the free graphite were sufficiently dispersed in the matrix of the sintered alloy. Therefore, the wear amount of the valve guide was approximately 78% of that of the conventional sintered alloy sample (sample No. 08), and the wear resistance was superior. Moreover, when Cu was added to the sintered alloy by adding the copper powder, the soft copper phase was dispersed, and the matrix of the sintered alloy was strengthened, whereby the wear amount of the valve guide was further decreased. The wear amount of the valve guide was decreased with the increase in the amount of Cu and was decreased to up to approximately 50% of that of the conventional sintered alloy sample (sample No. 08). In this case, when the amount of the copper powder was greater than 10 mass %, and the amount of Cu in the overall composition was greater than 10 mass %, the effect for decreasing the wear amount was not further improved.

In the sintered alloy sample of the sample No. 37 which did not include the copper powder, the strength of the matrix of the sintered alloy was low, whereby the compressive strength was low. When Cu was added to the sintered alloy by adding the copper powder, the matrix of the sintered alloy was strengthened, whereby the compressive strength was improved. In addition, as the amount of Cu in the overall composition was increased by increasing the amount of the copper powder, the compressive strength was improved. In the sintered alloy sample of the sample No. 38 in which the amount of the copper powder was 1.5 mass % and the amount of Cu in the overall composition was 1.5 mass %, the matrix of the sintered alloy was strengthened. In this case, the compressive strength was increased but did not reach a practical level. On the other hand, in the sintered alloy sample of the sample No. 39 in which the amount of the copper powder was 3 mass % and the amount of Cu in the overall composition was 3 mass %, the compressive strength reached the practical degree. When the amount of the copper powder was greater than 10 mass %, and the amount of Cu in the overall composition was greater than 10 mass %, the compressive strength was not much further improved.

As described above, in view of the strength of the sintered alloy, the amount of Cu in the overall composition was set to be not less than 3 mass %. Moreover, since the effects for improving the wear resistance and the strength were not efficiently increased for the increase of the amount of Cu, the upper limit of the amount of Cu was set to be 10 mass %.

Sixth Example

The effect of the amount of tin on the characteristics of a sintered valve guide was investigated. The iron powder, the iron-phosphorus alloy powder, the hard phase forming powder, the copper powder, the copper-tin alloy powder, and the graphite powder, all of which were used in the First Example, were prepared. These powders were mixed at mixing ratios shown in Table 11, and raw powders were obtained. The raw powders were formed into sintered alloy samples in the same manner as those in the First Example, whereby sintered alloy samples of the samples Nos. 43 to 46 were obtained. The wear test and the compressive strength test were performed on these sintered alloy samples under the same conditions as those in the First Example, and the wear amounts and the compressive strengths were measured. The overall compositions and the test results of these samples are shown in Table 12. It should be noted that the values of the sintered alloy sample of the sample No. 05 and the values of the conventional sintered alloy sample of the sample No. 08 in the First Example are also shown in Table 12.

TABLE 11

| | Mixing ratio mass % | | | | | | |
|---|---|---|---|---|---|---|---|
| Sample No. | Iron powder | Iron-phosphorus alloy powder | Hard phase forming powder | Copper powder | Copper-tin alloy powder | Graphite powder | Notes |
| 05 | Balance | 1.40 | 10.00 | 7.00 | — | 2.00 | |
| 43 | Balance | 1.40 | 10.00 | 5.00 | 2.00 | 2.00 | |
| 44 | Balance | 1.40 | 10.00 | 3.00 | 4.00 | 2.00 | |
| 45 | Balance | 1.40 | 10.00 | 1.00 | 6.00 | 2.00 | |
| 46 | Balance | 1.40 | 10.00 | — | 7.00 | 2.00 | |
| 08 | Balance | 1.40 | — | — | 5.00 | 2.00 | Alloy disclosed in Japanese Examined Patent Publication No. 55-034858 |

TABLE 12

| Sample | Composition mass % | | | | | | Wear amount μm | | | Compressive strength | |
|---|---|---|---|---|---|---|---|---|---|---|---|
| No. | Fe | P | Cu | Cr | C | Sn | VG | VS | Total | MPa | Notes |
| 05 | Balance | 0.28 | 7.00 | 1.20 | 2.15 | — | 31 | 3 | 34 | 621 | |
| 43 | Balance | 0.28 | 6.80 | 1.20 | 2.15 | 0.20 | 30 | 3 | 33 | 640 | |
| 44 | Balance | 0.28 | 6.60 | 1.20 | 2.15 | 0.40 | 29 | 2 | 31 | 659 | |
| 45 | Balance | 0.28 | 6.40 | 1.20 | 2.15 | 0.60 | 27 | 3 | 30 | 680 | |
| 46 | Balance | 0.28 | 6.30 | 1.20 | 2.15 | 0.70 | 27 | 2 | 29 | 693 | |

TABLE 12-continued

| Sample | Composition mass % | | | | | | Wear amount μm | | | Compressive strength | |
|---|---|---|---|---|---|---|---|---|---|---|---|
| No. | Fe | P | Cu | Cr | C | Sn | VG | VS | Total | MPa | Notes |
| 08 | Balance | 0.28 | 4.50 | — | 2.00 | 0.50 | 61 | 2 | 63 | 680 | Alloy disclosed in Japanese Examined Patent Publication No. 55-034858 |

According to the sintered alloy samples of the samples Nos. 05 and 43 to 46 in Table 11 and 12, the effects of adding Sn to the sintered alloy are shown.

Compared to the sintered alloy sample of the sample No. 05 which did not include Sn, even when Sn was added in the sintered alloys, the wear amounts of the valve guides were not decreased, and the wear resistances were superior. On the other hand, the compressive strengths were improved by adding Sn in the sintered alloys. In this case, as the amount of Sn in the sintered alloy was increased, greater amount of the liquid phase was generated in sintering, and the sintering was accelerated, whereby the compressive strength was increased. Specifically, when the amount of Sn was in the range of 0.6 to 0.7 mass %, the compressive strength was improved to be approximately equal to that of the conventional sintered alloy sample (sample No. 08). As described above, by adding Sn in the sintered alloy, the strength of the sintered alloy was improved while the wear resistance of the sintered alloy was maintained.

Seventh Example

The effect of the addition of various hard phase forming powders on the characteristics of a sintered valve guide was investigated. The iron powder, the iron-phosphorus alloy powder, the copper-tin alloy powder, and the graphite powder, all of which were used in the First Example, were prepared. In addition, hard phase forming powders having compositions shown in Table 13 were prepared. These powders were mixed at mixing ratios shown in Table 13, and raw powders were obtained. The raw powders were formed into sintered alloy samples in the same manner as those in the First Example, whereby sintered alloy samples of the samples Nos. 47 to 50 were obtained. The overall compositions of the samples of the samples Nos. 47 to 50 are shown in Table 14. The wear test and the compressive strength test were performed on these sintered alloy samples under the same conditions as those in the First Example, and the wear amounts and the compressive strengths were measured. The test results of these samples are shown in Table 15. It should be noted that the values of the conventional sintered alloy sample of the sample No. 08 in the First Example and the values of the sintered alloy sample of the sample No. 46 in the Sixth Example are also shown in Table 13 to 15.

TABLE 13

| Sample | Mixing ratio mass % | | | | | |
|---|---|---|---|---|---|---|
| | Iron | Iron-phosphorus | Hard phase forming powder | | Copper-tin | Graphite | |
| No. | powder | alloy powder | | Composition | alloy powder | powder | Notes |
| 46 | Balance | 1.40 | 10.00 | Fe—12Cr—1.5C | 7.00 | 2.00 | Hard phase (A) |
| 47 | Balance | 1.40 | 10.00 | Fe—5Mo—2V—6W—4Cr—1C | 7.00 | 2.00 | Hard phase (C) |
| 48 | Balance | 1.40 | 10.00 | Fe—35Mo—6Si | 7.00 | 2.00 | Hard phase (D) |
| 49 | Balance | 1.40 | 10.00 | Fe—35Mo—6Si—2Mn | 7.00 | 2.00 | Hard phase (E) |
| 50 | Balance | 1.40 | 10.00 | Co—28Mo—8Cr—2.5Si | 7.00 | 2.00 | Hard phase (F) |
| 08 | Balance | 1.40 | — | — | 5.00 | 2.00 | Alloy disclosed in Japanese Examined Patent Publication No. 55-034858 |

TABLE 14

| Sample | Composition mass % | | | | | | | | | | | | |
|---|---|---|---|---|---|---|---|---|---|---|---|---|---|
| No. | Fe | P | Cu | Sn | Cr | Mo | V | W | Si | Mn | Co | C | Notes |
| 46 | Balance | 0.28 | 6.30 | 0.50 | 1.20 | — | — | — | — | — | — | 2.15 | Hard phase (A) |
| 47 | Balance | 0.28 | 6.30 | 0.50 | 0.40 | 0.50 | 0.20 | 0.60 | — | — | — | 2.55 | Hard phase (C) |
| 48 | Balance | 0.28 | 6.30 | 0.50 | — | 3.50 | — | — | 0.60 | — | — | 2.15 | Hard phase (D) |
| 49 | Balance | 0.28 | 6.30 | 0.50 | — | 3.50 | — | — | 0.60 | 0.20 | — | 2.15 | Hard phase (E) |
| 50 | Balance | 0.28 | 6.30 | 0.50 | 0.80 | 2.80 | — | — | 0.25 | — | 6.15 | 2.15 | Hard phase (F) |
| 08 | Balance | 0.28 | 4.50 | 0.50 | — | — | — | — | — | — | — | 2.00 | Alloy disclosed in Japanese Examined Patent Publication No. 55-034858 |

TABLE 15

| Sample | Wear amount μm | | | Compressive strength | |
|---|---|---|---|---|---|
| No. | VG | VS | Total | MPa | Notes |
| 46 | 27 | 2 | 29 | 693 | Hard phase (A) |
| 47 | 25 | 2 | 27 | 704 | Hard phase (C) |
| 48 | 21 | 3 | 24 | 672 | Hard phase (D) |
| 49 | 20 | 2 | 22 | 695 | Hard phase (E) |
| 50 | 16 | 1 | 17 | 658 | Hard phase (F) |
| 08 | 61 | 2 | 63 | 680 | Alloy disclosed in Japanese Examined Patent Publication No. 55-034858 |

According to the sintered alloy samples of the samples Nos. 46 to 50 in Table 13 to 15, the effects of changing the kind of the hard phase are shown. According to these results, even when the kind of the hard phase was changed from the hard phase (A) to the hard phase (c), (D), (E), and (F), the wear amounts of the valve guides and the valve stems remained small, and the wear resistances were improved.

What is claimed is:

1. A sintered valve guide exhibiting a metallic structure having a mixed structure and a hard phase in which hard particles are dispersed in an alloy matrix, the mixed structure consisting of pearlite, an Fe—P—C ternary eutectic phase, a ferrite phase, a copper phase, and pores, the mixed structure consisting of, by mass %, 0.075 to 0.525% of P, 3.0 to 10.0% of Cu, 1.0 to 3.0% of C, and the balance of Fe and inevitable impurities, and the hard phase being dispersed at 2 to 15 mass % in the mixed structure.

2. The sintered valve guide according to claim 1, wherein the hard particles are concentrated in the alloy matrix of the hard phase.

3. The sintered valve guide according to claim 1, wherein the alloy matrix of the hard phase is one kind of an iron-based alloy and a cobalt-based alloy, and the hard particles are at least one kind selected from the group consisting of molybdenum silicides, chromium carbides, molybdenum carbides, vanadium carbides, and tungsten carbides.

4. The sintered valve guide according to claim 1, wherein the hard phase is made of at least one selected from the group consisting of (A) a hard phase consisting of, by mass %, 4 to 25% of Cr, 0.25 to 2.4% of C, and the balance of Fe and inevitable impurities, (B) a hard phase consisting of, by mass %, 4 to 25% of Cr, 0.25 to 2.4% of C, at least one of 0.3 to 3.0% of Mo and 0.2 to 2.2% of V, and the balance of Fe and inevitable impurities, (C) a hard phase consisting of, by mass %, 4 to 8% of Mo, 0.5 to 3% of V, 4 to 8% of W, 2 to 6% of Cr, 0.6 to 1.2% of C, and the balance of Fe and inevitable impurities, (D) a hard phase consisting of by mass %, 0.5 to 10% of Si, 10 to 50% of Mo, and the balance of Fe and inevitable impurities, (E) a hard phase consisting of, by mass %, 0.5 to 10% of Si, 10 to 50% of Mo, at least one selected from the group consisting of 0.5 to 10% of Cr, 0.5 to 10% of Ni, and 0.5 to 5% of Mn, and the balance of Fe and inevitable impurities, and (F) a hard phase consisting of, by mass %, 1.5 to 3.5% of Si, 7 to 11% of Cr, 26 to 30% of Mo, and the balance of Co and inevitable impurities.

5. The sintered valve guide according to claim 1, wherein at least one kind selected from the group consisting of manganese sulfide, calcium fluoride, molybdenum disulfide, and magnesium metasilicate minerals is dispersed at not more than 2 mass % in the metallic structure.

6. The sintered valve guide according to claim 1, wherein the hard phase is made of at least one selected from the group consisting of (A) a hard phase consisting of, by mass %, 4 to 25% of Cr, 0.25 to 2.4% of C, and the balance of Fe and inevitable impurities, (B) a hard phase consisting of, by mass %, 4 to 25% of Cr, 0.25 to 2.4% of C, at least one of 0.3 to 3.0% of Mo and 0.2 to 12% of V, and the balance of Fe and inevitable impurities, (C) a hard phase consisting of, by mass %, 4 to 8% of Mo, 0.5 to 3% of V, 4 to 8% of W, 2 to 6% of Cr, 0.6 to 1.2% of C, and the balance of Fe and inevitable impurities, (D) a hard phase consisting of, by mass %, 0.5 to 10% of Si, 10 to 50% of Mo, and the balance of Fe and inevitable impurities, and (E) a hard phase consisting of, by mass %, 1.5 to 3.5% of Si, 7 to 11% of Cr, 26 to 30% of Mo, and the balance of Co and inevitable impurities.

7. The sintered valve guide according to claim 1, wherein at least one kind selected from the group consisting of calcium fluoride, molybdenum disulfide, and magnesium metasilicate minerals (i) is present and dispersed in metallic structure and (ii) does not exceed more than 2 mass % of the metallic structure.

8. The sintered valve guide according to claim 1, wherein at least one kind selected from the group consisting of calcium fluoride and magnesium metasilicate minerals (i) is present and dispersed in the metallic structure and (ii) does not exceed more than 2 mass % of the metallic structure.

9. The sintered valve guide according to claim 1, wherein the hard particles are at least one kind selected from the group consisting of chromium carbides, molybdenum carbides, vanadium carbides, and tungsten carbides.

10. A sintered valve guide exhibiting a metallic structure having a mixed structure and a hard phase in which hard particles are dispersed in an alloy matrix, the alloy matrix being an iron-based alloy or an iron-chromium alloy, the mixed structure consisting of pearlite, an Fe—P—C ternary eutectic phase, a ferrite phase, a copper phase, and pores, the mixed structure consisting of, by mass %, 0.075 to 0.525% of P, 3.0 to 10.0% of Cu, 1.0 to 3.0% of C, not more than 1.1 mass % of Sn, and the balance of Fe and inevitable impurities, and the hard phase being dispersed at 2 to 15 mass % in the mixed structure, and the copper phase is partially or wholly made of a copper-tin alloy phase.

11. The sintered valve guide according to claim 10, wherein the hard phase is made of at least one selected from the group consisting of (A) a hard phase consisting of, by mass %, 4 to 25% of Cr, 0.25 to 2.4% of C, and the balance of Fe and inevitable impurities, (B) a hard phase consisting of, by mass %, 4 to 25% of Cr, 0.25 to 2.4% of C, at least one of 0.3 to 3.0% of Mo and 0.2 to 2.2% of V, and the balance of Fe and inevitable impurities, (C) a hard phase consisting of, by mass %, 4 to 8% of Mo, 0.5 to 3% of V, 4 to 8% of W, 2 to 6% of Cr, 0.6 to 1.2% of C, and the balance of Fe and inevitable impurities, and (D) a hard phase consisting of, by mass %, 0.5 to 10% of Si, 10 to 50% of Mo, and the balance of Fe and inevitable impurities.

12. The sintered valve guide according to claim 10, wherein at least one kind selected from the group consisting of calcium fluoride, molybdenum disulfide, and magnesium metasilicate minerals (i) is present and dispersed in metallic structure and (ii) does not exceed more than 2 mass % of the metallic structure.

13. The sintered valve guide according to claim 10, wherein at least one kind selected from the group consisting of calcium fluoride and magnesium metasilicate minerals (i) is present and dispersed in the metallic structure and (ii) does not exceed more than 2 mass % of the metallic structure.

* * * * *